US005794789A

United States Patent [19]

Payson et al.

[11] Patent Number: 5,794,789

[45] Date of Patent: Aug. 18, 1998

[54] SEMI-AUTOMATED INTEGRATED SORT SYSTEM

[76] Inventors: William H. Payson, 1121 Arlington Blvd, Apt. 843, Arlington, Va. 22209; John B. Payson, 309D Woodcreek Dr., Apt. 111, Boling Brook, Ill. 60440

[21] Appl. No.: 571,805

[22] Filed: Dec. 13, 1995

[51] Int. Cl.[6] ..... B07C 5/00

[52] U.S. Cl. ..... 209/549; 209/583; 209/584; 209/702; 209/942

[58] Field of Search ..... 209/702, 703, 209/900, 942, 549, 546, 583, 584, 44.4

[56] References Cited

U.S. PATENT DOCUMENTS

| | | | |
|---|---|---|---|
| 3,587,856 | 6/1971 | Lemelson . | |
| 3,889,811 | 6/1975 | Yoshimura . | |
| 4,181,948 | 1/1980 | Jackson et al. . | |
| 4,778,062 | 10/1988 | Pavie et al. . | |
| 5,042,667 | 8/1991 | Keough . | |
| 5,363,971 | 11/1994 | Weeks et al. . | |
| 5,420,403 | 5/1995 | Allum et al. . | |
| 5,472,097 | 12/1995 | Villachica | 209/900 X |
| 5,590,794 | 1/1997 | Zachary | 209/702 |
| 5,620,102 | 4/1997 | Finch, Jr. | 209/942 X |

FOREIGN PATENT DOCUMENTS

| | | | |
|---|---|---|---|
| 454104 | 1/1950 | Italy | 209/702 |

*Primary Examiner*—David H. Bollinger

*Attorney, Agent, or Firm*—William L. Feeney; Kerkam, Stowell, Kondracki & Clarke, P.C.

[57] ABSTRACT

Inter-related devices and methods to increase sort productivity, provide for the ready integration of shipment data into a central computer system, permit centralized management and control over multiple autonomous sort operations, and integrate materials handling of the sorted shipments into the sort process. The devices and methods provide the foundation for an integrated shipment and information processing system without the complexity of automated equipment or the limitations of manual operations. The semi-automated integrated sort system has an array of chutes that flow shipments into containers or bins. The entrance to each chute is blocked by a computer-controlled gate. Detectors are placed in the chutes to detect shipments and monitor container/bin status. The chute gates, sensors, and other sort-related apparatus are connected to a computer. Automated or semi-automated data entry equipment connected to the computer provides the necessary data input. If centralized data collection or shipment management is required, the computer is connected to a central computer or computer network.

49 Claims, 14 Drawing Sheets

COMPUTER
416
400
432
430N
430
434
440
444
444
434
444
440
430U
442
436
438
436S

SEMI-AUTOMATED INTEGRATED SORT SYSTEM

BACKGROUND OF THE INVENTION

This invention is provides an integrated physical/electronic system, and a distribution method by which manual shipment handling can be integrated with automated data and shipment flow management and materials handling of the sorted shipments. In particular, the apparatus to be described is well suited to sorting, distributing, and collecting information for time-definite letter, flat, and parcel shipments. The system integrates data collection and management, shipment sortation, and the materials handling of the sorted and consolidated shipments. This allows a comparatively simple electro-mechanical device to provide productivity and information technology benefits similar to those provided by high cost automated systems integrating manual handling, automated data and shipment flow management, and materials handling, eliminates a number of steps in shipment processing, significantly reducing processing costs and the potential for human error.

Current shipment processing options are, for many purposes, comparatively unsatisfactory. At present delivery companies have two basic options to sort and process shipments (parcels, flats, and letters). The first option is manual sortation. Manual sortation requires relatively little capital expenditure for equipment and is very flexible. However, manual sortation is labor intensive and does not work well for complex distribution patterns, such as directing a shipment into one of 100 bins. As a result, manual sortation often requires multiple sorts to produce the desired sort pattern.

Manual sortation is also error prone and requires an extra information collection step for integration with tracking and tracing systems. Finally, manual sortation processes also typically require significant supervision to ensure that workers maintain reasonable productivity and sortation accuracy. As a result, while manual sortation has some advantages, it is best for companies with access to low cost labor, limited time-windows for shipment sortation, simple distribution patterns, and no need for tracking and tracing or recording shipment data electronically.

In contrast, automated processing provides higher productivity, is comparatively easy to integrate with tracking and tracing systems and, with proper design, can provide high sort accuracy. However, automated processing equipment is expensive and typically requires more space than well-designed manual operations. This means that automated processing is typically not cost effective unless the equipment can be operated intensively (i.e., operated many hours per day). As a result, automated operations are most effective for companies handling high shipment volumes with long processing time-windows and the ability to centralize processing into a limited number of facilities. Even when automated processing may be justified on a cost-basis, the high capital cost of procuring automated technology is a strong deterrent to automation.

Most delivery companies have sortation requirements that do not fit either pattern very well. For example, the United States Postal Service, which has some of the most complex distribution requirements of any company in the world, must sort each piece of mail to one of approximately 10,000 area offices (post offices) for delivery by one of approximately 240,000 letter carriers, for delivery to one of approximately 100 million addresses. With more than 10,000 facilities that need to process shipments, it would not be economic for the Postal Service to install automated processing equipment in every facility.

However, given the complexity of the current distribution process and the Postal Service's high labor costs, manual sortation is inefficient, expensive, and requires "scheme knowledge"[1] that limits the Postal Service's ability to use part-time labor to maintain operating flexibility. Furthermore, as with other delivery companies, the Postal Service is gradually shifting towards time-definite delivery with integrated tracking and tracing. This places a further burden on manual operations since data collection requires a separate step. In summary, existing manual and automated sortation systems do not do a very good job of meeting a broad class of shipment processing requirements.

[1]Scheme knowledge involves knowing through practice and experience how to sort a shipment in a given sort scheme to reduce or eliminate the requirement to look-up sort information. The need for scheme knowledge on complex sortation patterns makes it difficult or impossible to use part-time or unskilled labor, which can increase labor costs and increases the potential for error.

OBJECTS AND SUMMARY OF THE INVENTION

A primary object of the present invention is to provide a new and improved system and method for sorting packages.

A more specific object of the present invention is to provide package sorting which combines the lower capital cost of manual systems with the higher efficiency of automated systems.

Yet another object of the present invention is to provide for improved flexibility in the sorting and distribution of large volumes of packages.

A still further object of the present invention is to provide for accurate tracking of packages over numerous steps in a distribution and sorting process.

Yet another object of the present invention is to minimize the number of times destination information must be input or manually accessed for a given package in a stream of packages proceeding in a sort and distribution system.

A still further object of the present invention is to prevent errors in the sorting of packages.

A still further object of the present invention is to allow the easy correction of any sorting errors which do occur.

The present invention may be described as a package sort system including:

- a sorter input work station from which packages in a package stream are supplied to a sorter person;
- a plurality of manual ports adjacent the sorter input work station for the sorter person to manually insert packages from the sorter input work station for further processing;
- a plurality of gates, each associated with at least a corresponding one or more of the manual ports, the gates individually movable between a closed position blocking access to corresponding manual ports and an open position allowing access to corresponding manual ports; and
- a computer holding destination information relative to intended destinations of packages in the package stream at the sorter input work station, the computer operably connected to the plurality of gates for allowing access to a particular manual port based on the destination information for a particular package being manually sorted by the sorter person at a given time such that the sorter person may manually insert that package in particular manual port.

As used herein, a package refers to a flat, envelope, or any other type of package. The present invention allows its distribution through a postal or similar distribution system.

A plurality of gate openers are provided, each operably connected to a corresponding one of the plurality of gates for opening that gate and operably connected to the computer. The computer is operable to send opening signals to the plurality of gate openers such that the gates are opened dependent on the destination information for a particular package being manually sorted by the sorter person at a given time.

Alternately, a plurality of gate locks are provided, each operably connected to a corresponding one of the plurality of gates for locking that gate and operably connected to the computer, wherein the computer is operable to send unlocking signals to the plurality of gate locks such that the gates are unlocked dependent on the destination information for a particular package being manually sorted by the sorter person at a given time such that the sorter person can manually open a correct one of the gates for the particular package.

Alternately, a plurality of gate locks are provided, each operably connected to a corresponding one of the plurality of gates for locking that gate and operably connected to the computer, and a plurality of gate sensors, each corresponding to one of the plurality of gates and sensing when that gate is moved, and wherein the computer is operable to control the plurality of gate locks such that each gate is locked responsive to movement sensed by its gate sensor and dependent on the destination information for a particular package being manually sorted by the sorter person at a given time such that the sorter person can manually open a correct one of the plurality of gates for the particular package.

A plurality of passageways are provided, each having a corresponding outlet and each passageway corresponding to a corresponding one of the plurality of manual ports and communicating therewith such that a package inserted into a manual port proceeds in the corresponding passageway to the corresponding outlet. The passageways may be chutes, or have conveyors or other package transporting means. A first cart is at the outlets of the passageways, the first cart having bins, each bin receiving packages from a corresponding outlet and corresponding to a corresponding one of the manual ports such that packages inserted into a manual port proceed into the corresponding bin; and a second cart having bins and constructed as recited for the first cart. The first cart is movable from the outlets of the passageways and the second cart is movable into a location previously occupied by the first cart such that it may assume the receiving of packages from the outlets as previously performed by the first cart.

An induction work station is provided into which packages of the package stream go in an order, the computer storing information indicating the order of the packages going into the induction work station; and a sort sensor at the sorter input work station and operably connected to provide a signal to the computer when a particular package is ready to be sorted. The sorter input work station is operably connected to the induction work station such that packages from the induction work station proceed in order to the sorter input work station and from which packages in the package stream are supplied to a sorter for sorting, and wherein the computer controls the gates to direct sorting of a particular package responsive to the destination location of the package as determined from the order of packages stored by the computer.

A bar code reader is adjacent the induction work station and operable to input destination information to the computer based on the reading of bar code on packages. An information input interface is operably connected to the computer for entering destination information to the computer, and wherein the input interface is selected from the group consisting of:

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer.

The present invention may alternately be described as a package sort system including:

a sorter input work station from which packages in a package stream are supplied to a sorter person;

a plurality of manual ports adjacent the sorter input work station for the sorter person to manually insert packages from the sorter input work station for further processing;

a plurality of visual indicators, each associated with at least a corresponding one of the manual ports, the visual indicators indicating to the sorter person which of plurality of manual ports a package should be inserted in;

a plurality of port sensors operable to sense which of the plurality of manual ports a package is inserted into; and a computer holding destination information relative to intended destinations of packages in the package stream at the sorter input work station, the computer operably connected to the plurality of port sensors such that the computer receives a signal when a package is misplaced into an incorrect port; and a downstream location downstream from the plurality of ports such that packages inserted into the plurality of ports proceed to the downstream location; and wherein the computer is operable to track the misplaced package until it reaches the downstream location such that the misplacement of the misplaced package can be corrected at the downstream location.

The computer is operable to record a performance rate for a given sorter person, the performance rate dependent on the accuracy of the sorter person in inserting the packages into proper manual ports.

An induction work station is provided into which packages of the package stream go in an order, the computer storing information indicating the order of the packages going into the induction work station. There is a sort sensor at the sorter input work station and operably connected to provide a signal to the computer when a particular package is ready to be sorted. The sorter input work station is operably connected to the induction work station such that packages from the induction work station proceed in order to the sorter input work station and from which packages in the package stream are supplied to a sorter for sorting, and wherein the computer directs sorting of a particular package responsive to the destination location of the package as determined from the order of packages stored by the computer. An information input interface is operably connected to the computer for entering destination information to the computer, and wherein the input interface is selected from the group consisting of:

a bar code reader adjacent the induction work station and operable to input destination information to the computer based on the reading of bar code on packages;

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer. More preferably, the input interface includes at least two members of the recited group.

The present invention may alternately be described as a package sort system including:

a sorter input work station from which packages in a package stream are supplied to a sorter person; a plurality of manual ports adjacent the sorter input work station for the sorter to manually insert packages from the sorter input work station for further processing;

a plurality of indicators, each associated with at least a corresponding one or more of the manual ports, the indicators indicating to the sorter person which of the manual ports packages should be inserted into;

a computer holding destination information relative to intended destinations of packages in the package stream at the sorter input work station, the computer operably connected to the plurality of indicators for controlling them based on the destination information for a particular package being manually sorted by the sorter person at a given time such that the sorter person manually inserts that package in a particular manual port;

a plurality of passageways, each having a corresponding outlet and each passageway corresponding to a corresponding one of the plurality of manual ports and communicating therewith such that a package inserted into a manual port proceeds in the corresponding passageway to the corresponding outlet;

a plurality of at least partially confined holding zones at the outlets of the passageways, there being a distinct holding zone at each outlet; and wherein the holding zones are movable relative to the outlets such that an empty holding zone can be replaced for a full holding zone without moving the corresponding outlet and the corresponding passageway. The system further includes first and second carts, and wherein each of the holding zones is one of a plurality of bins on the first and second carts, each bin receiving packages from a corresponding outlet and corresponding to a corresponding one of the manual ports such that packages inserted into a manual port proceed into the corresponding bin; and wherein the first cart is movable from the outlets of the passageways and the second cart is movable into a location previously occupied by the first cart such that it may assume the receiving of packages from the outlets as previously performed by the first cart. A plurality of transfer sensors are operably connected to the computer and sensing when a package is transferred from one of the outlets to the corresponding bin. An induction work station is provided into which packages of the package stream go in an order, the computer storing information indicating the order of the packages going into the induction work station, the induction work station is operably connected to the sorter input work station such that packages from the induction work station proceed in order to the sorter input work station. A sort sensor is at the sorter input work station and operably connected to provide a signal to the computer when a particular package is ready to be sorted. The computer stores information corresponding to an indication of the transfer of each package and wherein the computer directs sorting of a particular package responsive to the destination location of the package as determined from the order of packages stored by the computer by controlling the indicators.

The indicators are visual indicators. The system further includes a plurality of port sensors operable to sense which of the plurality of manual ports a package is inserted into. The computer is operably connected to the plurality of port sensors such that the computer receives a signal when a package is misplaced into an incorrect port; and wherein the computer is operable to record a performance rate for a given sorter person, the performance rate dependent on the accuracy of the sorter person in inserting the packages into proper manual ports.

The indicators are selected from the group consisting of:

gate openers which open the gates as appropriate for insertion of the packages, the opening of a gate thus indicating which manual port should be used; and gate locks which lock and unlock the gates as appropriate for insertion of the packages, an unlocked condition of a gate thus indicating which manual port should be used and a locked condition of a gate thus indicating that the corresponding manual port should not be used.

The present invention may alternately be described as a package sort system including:

a computer holding destination information relative to intended destinations of packages in the package stream which are to be sorted;

an induction work station into which packages of the package stream go in an order, the computer storing information indicating the order of the packages going into the induction work station;

a sorter input work station operably connected to the induction work station such that packages from the induction work station proceed in order to the sorter input work station and from which packages in the package stream are supplied to a sorter person for sorting;

a plurality of manual ports adjacent the sorter input work station for the sorter person to insert packages from the sorter input work station for further processing; and a sort sensor at the sorter input work station and operably connected to provide a signal to the computer when a particular package is ready to be sorted; and wherein the computer is operable to direct sorting of the particular package responsive to the destination location of the package as determined from the order of packages stored by the computer.

The present invention may also be described as a method of using the system.

The semi-automated integrated sort system of the present invention was specifically designed to address the stated objects. It would be valuable for the Postal Service and other companies with complex disbursed distribution requirements. Because the semi-automated integrated sort system uses a human operator to physically route the package into the correct chute, the system has few moving parts and system cost and complexity are accordingly reduced relative to automated systems. While the system does require a significant investment in computer technology, the cost of computer technology is declining. As such, the additional capital costs of the semi-automated integrated sort system relative to manual sortation will continue to decline. Accordingly, the benefits of the system relative to manual sortation will increase with overall technology development.

While the system provides a wide range of benefits, because the system design is comparatively simple, the capital and maintenance costs of the system will be significantly lower than those of an automated system. Accordingly, we anticipate that the system will provide significant benefits in cases where:

1. Low shipment volumes or a short processing window mean that automation is not cost effective; or
2. Complex sort requirements (e.g., sorting into 1 of 800 bins) mean that automated sortation would be operationally problematic; or
3. Integrated data collection is required on a currently manual operation; or
4. Productivity benefits from applying the system to existing manual operations would outweigh system acquisition costs.

The present invention consists of a number of interrelated elements. The primary physical element is an array of chutes (more generally called passageways) that flow shipments to one of a number of shipment consolidation containers or bins. A computer-controlled gate is placed at the entry to the chute, blocking the entrance to the chute so that a shipment cannot be placed into a chute that the computer has not activated or enabled. A sensor within the chute detects when a shipment has been placed into the correct chute to enable the computer to determine when a sortation has been completed. This sensor, or another separate sensor, is placed so as to detect when the container or bin used to consolidate the sorted pieces is full and needs to be replaced or emptied. A device is placed near the end of the chute to block the chute while the container is being changed or the bin is being emptied, thus allowing the computer to determine which container a given shipment has been placed in to facilitate down-stream shipment tracking.

These systems are connected to a computer controller. Power for the systems may be provided by an independent power unit or by the computer controller. The computer controller is connected to a computer, which is also connected to one or more data entry devices, with the primary data entry device involving automated data entry such as bar-code reading or image recognition, or semi-automated data entry such as voice recognition. Manual data entry such as keyboard entry may be used as a backup method in the event the primary mode of data entry is unsuccessful. The computer runs a computer program(s) that fills a number of functions. At a minimum the computer program(s) must be capable of recognizing the data entered by the data input device, associating the data entered with the desired destination chute/container, enabling the appropriate chute via the computer controller, informing the operator of the correct chute via a computer monitor, chute light, or other method, detecting when a consolidation bin or container is full and needs to be replaced, and notifying the system operator or another person of a full bin or full container. Under standard operation the system would perform a wide range of additional functions such as:

1. Forwarding shipment tracking and tracing data to a central computer;
2. Forwarding shipment billing information and other shipment information to a central computer (e.g., weight, sender, delivery address, special services required, etc.);
3. Tracking the semi-automated integrated sort system operator's productivity and work performance;
4. Relaying operating data to a central facility management system;
5. Printing bar-codes or other machine-readable data for shipments that lack this data;
6. Printing or assigning routing tags for consolidation containers and providing tracking data on which pieces are in a given container; and
7. Checking with (or receiving transmissions from) a central computer to determine if there are any shipment forwarding instructions or other special handling requirements applicable to the specific shipment being processed.

The interfaces between the computer controller and the chute, sensor, and gate system are conventional, such as parallel or serial cables. Depending on the demands placed by automated data entry and network operation on the computer processor, one computer may be able to handle several sort operators' chutes. In addition to the components outlined above, depending on deployment requirements, the semi-automated integrated sorter may also be provided with:

1. A bar-code or label printer;
2. An electronic scale;
3. A computer network interface;
4. Computer controlled lights to facilitate sorting;
5. Additional sets of computer controlled lights of a different color from the first set of lights to allow more than one sorter to work the same set of chutes by sorting only into bins lit by a particular color of light.
6. Computer-controlled lights to identify overall system status (e.g., green indicates that the semi-automated integrated sort system is currently operational and processing, red indicates that the system is awaiting shipments to begin processing);
7. Computer-controlled lights to indicate consolidation container/bin status;
8. Computer-controlled lights to indicate the operational status of the ongoing sort.

To facilitate efficient processing, the device may also be equipped with one or more shipment holding bins, equipped with indicator lights and sensors. The holding bin(s) would be used to store a shipment that could not be efficiently processed at that time, without requiring additional data entry. For example, if a shipment did not contain machine readable data, a video image of the shipment address could be sent via the computer network to a remote encoding site, for data entry. To maintain high sort productivity on the sort station, the system would light a "insert" light on one of the holding bins. The operator would then insert the package into the holding bin, triggering the sensor and turning off the insert light. The operator could then process other shipments. Once the shipment data was entered at the remote location, the system would turn-on the withdraw light and, once the operator withdrew the shipment from the bin, turn on the appropriate chute light, or print a shipment-specific label. The use of a holding bin would thus allow higher sort throughout.

A variation on this would be to use the bin to hold packages destined for a particular chute while the container on that chute was being changed. Once the container was changed, the withdraw light would turn-on, the operator could sort to the replaced container-thus reducing the need for more complex chute terminal apparatus.

A final variation would be to use an ordered bin or container system, whereby shipments would be inserted into a holding bin, and withdrawn in a particular order, such that the system, by monitoring sensors located at the entry and exit of the bin, could determine which shipment was being inserted or withdrawn from the bin, and could associate the appropriate electronic data with the shipment.

While this description is focused on an individual semi-automated integrated sort system, the primary purpose of the invention is to provide an integrated processing environment which would be comprised of many inter-linked semi-automated integrated sort systems. As such, while a single semi-automated integrated sort system would provide benefits and might be useful in some situations, the primary benefits of the system will not be realized without a broader deployment. This would likely involve the deployment of several types of semi-automated integrated sort systems, each customized for specific shipment characteristics and processing requirements.

For example, an integrated processing environment might include: Multiple semi-automated integrated sort systems designed for shipment induction that would have bar-code printing capabilities to automate data input on all future sorts of that shipment; multiple primary sortation systems designed to sort packages to a specific regional facility; multiple secondary sortation systems designed to sort packages destined within a specific facility to a specific zip-code or city; and multiple area office systems to sort packages to a specific carrier and provide the carrier with manifest data and other delivery information.

While this description does not extensively detail the implications of an integrated computer network interface, the benefits would be significant. By linking the semi-automated integrated sort systems together and using automated data entry, the integrated processing environment would provide the data needed for comprehensive shipment tracking and tracing and could also be used to collect shipment billing information, customer shipping data, employee performance data, and traffic flow data.

Furthermore, integrating shipment processing with a central computer system would allow the central computer system to provide information for a number of value-added functions, such as:

- in-transit shipment forwarding;
- shipment manifesting (including special service listing);
- applying the shipment consignee's delivery preferences;
- identifying impending service failures to implement remedial action;
- notifying recipients and senders of shipment status with e-mail, faxes, or other electronically prepared messages;
- adjusting shipment routings to optimize transportation utilization;
- using centralized data collection to enable remote operations monitoring and detailed employee and manager performance assessments; and
- improving operations planning with real-time operations and shipment feed-back.

DESCRIPTION OF THE DRAWINGS

For a better understanding of the features of the invention and its use, reference is made to the following detailed descriptions to be read with reference to the accompanying drawings, wherein.

DETAILED DESCRIPTIONS

Figure 1:
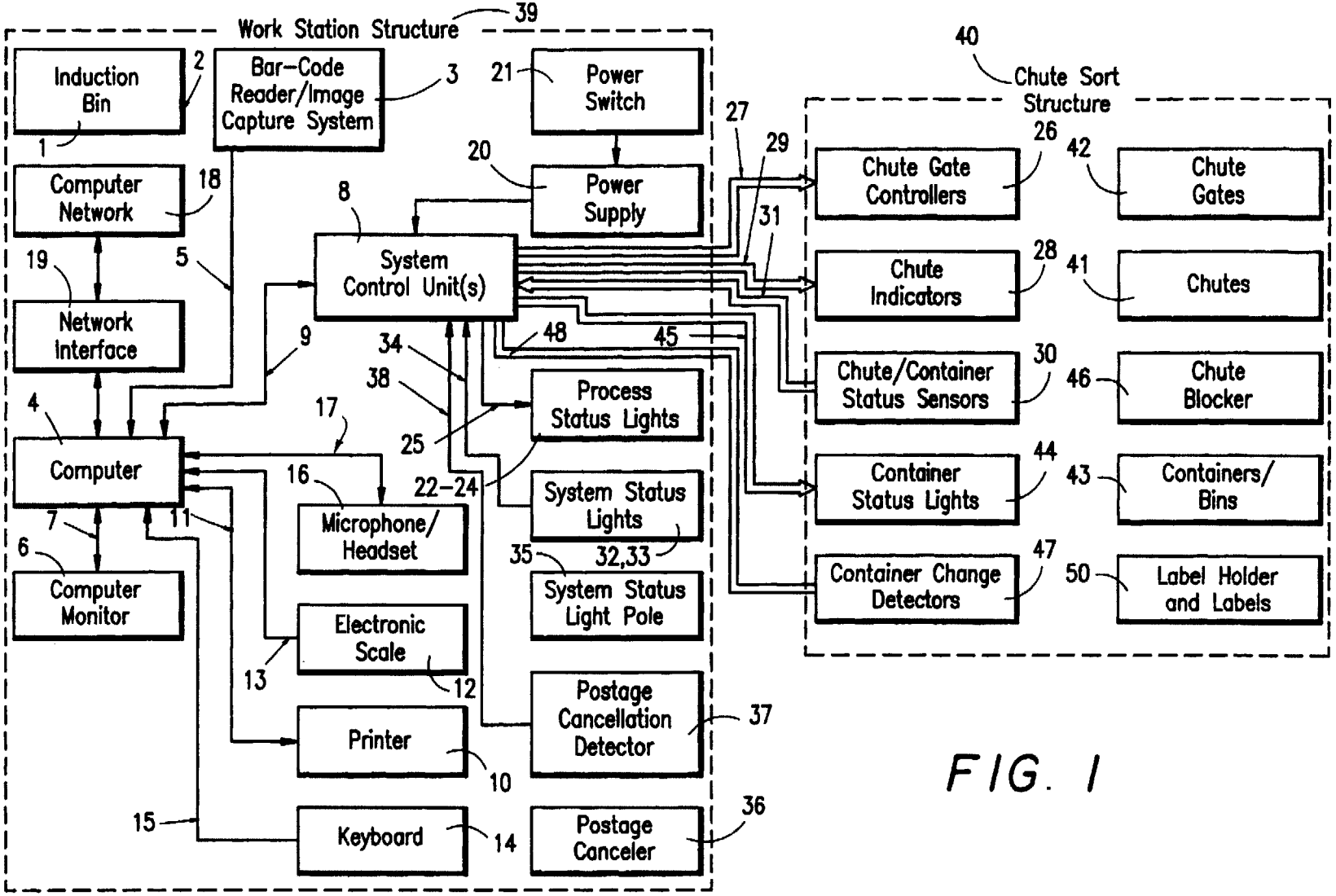
FIG. 1 provides a generalized schematic of the invention, showing the principal components employed in the integrated semi-automated parcel sorting system.

FIG. 1 presents a generalized schematic diagram of the semi-automated integrated sort system. The device consists of an induction bin 1 which holds shipments awaiting induction and initial processing. The induction bin 1, contains an opening 2 for withdrawing shipments for induction and initial processing. A bar-code reader/image capture system 3 is located above the opening to automatically scan packages as they are removed from the induction bin, and is connected to the computer 4 by an interface cable 5 used to transmit data to/from the computer. The computer is connected to a computer monitor 6 by a standard video display cable 7, to a system control unit 8 by a parallel cable connection 9, to a printer 10 by a printer cable 11, and to an electronic scale 12 by a serial cable 13. The computer is also connected to a keyboard 14 by a keyboard cable 15, and to the microphone/headset 16 by an audio input and output cable 17. As a primary goal of the operation of this configuration of the invention is to capture the shipment data and provide it to a central computer system, the computer is also connected to a computer network 18 by a network interface 19.

The system control unit 8 is, in turn, connected to a power supply 20 controlled by a power switch 21. The system control unit 8 is also connected to process status lights 22, 23, and 24 by wires 25 , to the chute gate controller 26 by a parallel cable(s) 27, to the chute indicators 28 by a parallel cable(s) 29, to the chute sensors 30A and container sensors 30B by a parallel cable(s) 31[2], and to the system status lights 32 and 33 by wires 34. The system status lights 32 and 33 are located on top of a pole 35 to increase the visibility of the system status lights. If the system will be required to handle stamped or postal metered shipments, the system will be equipped with a postage canceler 36, monitored by a cancellation detector 37 connected to the control unit 8 by wires 38. The system control unit 8 and the computer 4 are contained in a cabinet under the workstation structure 39, which is designed to provide an ergonomic placement of the other system components.

[2]While there are several options for the sensors, including electromechanical, pressure pads, and photo-gates. The standard sensor envisioned here is a photo-gate, consisting of a photo-emitter and a photo-detector, which is intermittently scanned by the controller such that the time between scans is less than the time required for a package to pass by. The controller looks for a drop-in the amount of current passing through the photo-detector, which indicates that the light beam has been interrupted. A prolonged drop-off would indicate a jam, sensor failure, or full container (depending on the type of sensor deployment).

On top of the workstation structure 39 is a chute sort structure 40, which contains multiple chutes 41 large enough to accommodate the shipments to be sorted. The chute sort structure 40 also contains the chute gate controller 26, which controls the individual chute gates 42, which are located at the entrance to the chutes 41 and are designed to block the chutes 41 when in a down position. This allows the computer to control sorting by physically preventing shipments from being placed in the wrong chute. The chute sort structure 40 also contains the chute indicators 28, the chute/container sensor 30, and part of the wiring associated with 26, 28 and 30.

At the bottom of each chute is a container or bin 43 which holds the sorted shipments. A chute sensor 30A is located at the end of the chute to detect shipments entering the container. A container sensor 30B is positioned so that, when the container or bin nears capacity the shipments in the container/bin will continuously block the container sensor 30B. This allows the computer 4 to determine when the container or bin 43 needs to be replaced or emptied. When the computer 4 detects that a container or bin 43 is nearing capacity, the computer 4 sends a signal to a container status light 44, which is located near the container or bin 43 that needs to be replaced or emptied, and is connected to the system controller 8 by a wire or cable 45. When the operator or another individual is ready to replace or empty the container or bin, he or she will remove or empty the container or bin.

The process of removing or emptying the bin will automatically deploy a chute blocker 46 located at the bottom of the chute 41, blocking any shipments sorted into the chute 41 at the bottom of the chute 41 until after the container or bin is replaced or emptied, lowering the chute blocker 46, allowing the shipments to flow into new or empty containers or bins. The chute blocker 46 is monitored by a container change sensor 47, which is connected to the system controller 8 by an cable or wire 48. Since the chute blocker 46 deploys when the container or bin 43 is emptied, which triggers the container change sensor 47, the computer 4 is able to determine the particular container 43 or unload batch (from a bin 43) an individual shipment is in, even if the shipment was sorted at roughly the same time as the container/bin was replaced or emptied. This facilitates shipment information management. To further facilitate shipment information management, a container label holder 49 is placed near each container/bin 43 with labels 50 specific to that container/bin 43, and with each label sequentially numbered or ordered. By applying the next label in sequence to the removed container 43 or to the shipment consolidation container used to empty the bin 43, the computer 4 can associate all of the shipments in the container or bin 43 with a specific container label, enabling downstream shipment tracking.

Since the semi-automated integrated sort system is envisioned as a system of multiple inter-related devices and procedures, each device would not require the full array of components illustrated in FIG. 1. In addition, some of the devices would be optional depending on the specific requirements imposed on the system. At a basic level, the semi-automated integrated sort system has the following components:

- Sortation chutes (more generally passageways for sorted packages) having manual ports at their entrances and outlets at their exits;
- An automated (e.g., bar-code reading) or semi-automated (e.g., voice recognition) means of data entry;
- A materials handling approach to empty the chutes (e.g., readily accessible bins, sacks, or containers, or a conveyer system provide holding zones at the outlets of the chutes);
- A computer-controlled method to indicate the appropriate chute for sortation; and
- A computer-network interface or other means of readily exchanging data with a central computer unit or system.

The additional components, such as computer-enabled gates and sort sensors to verify successful sortation and/or monitor container status provide further benefit, such as improved information management and better process control.

Figure 2:
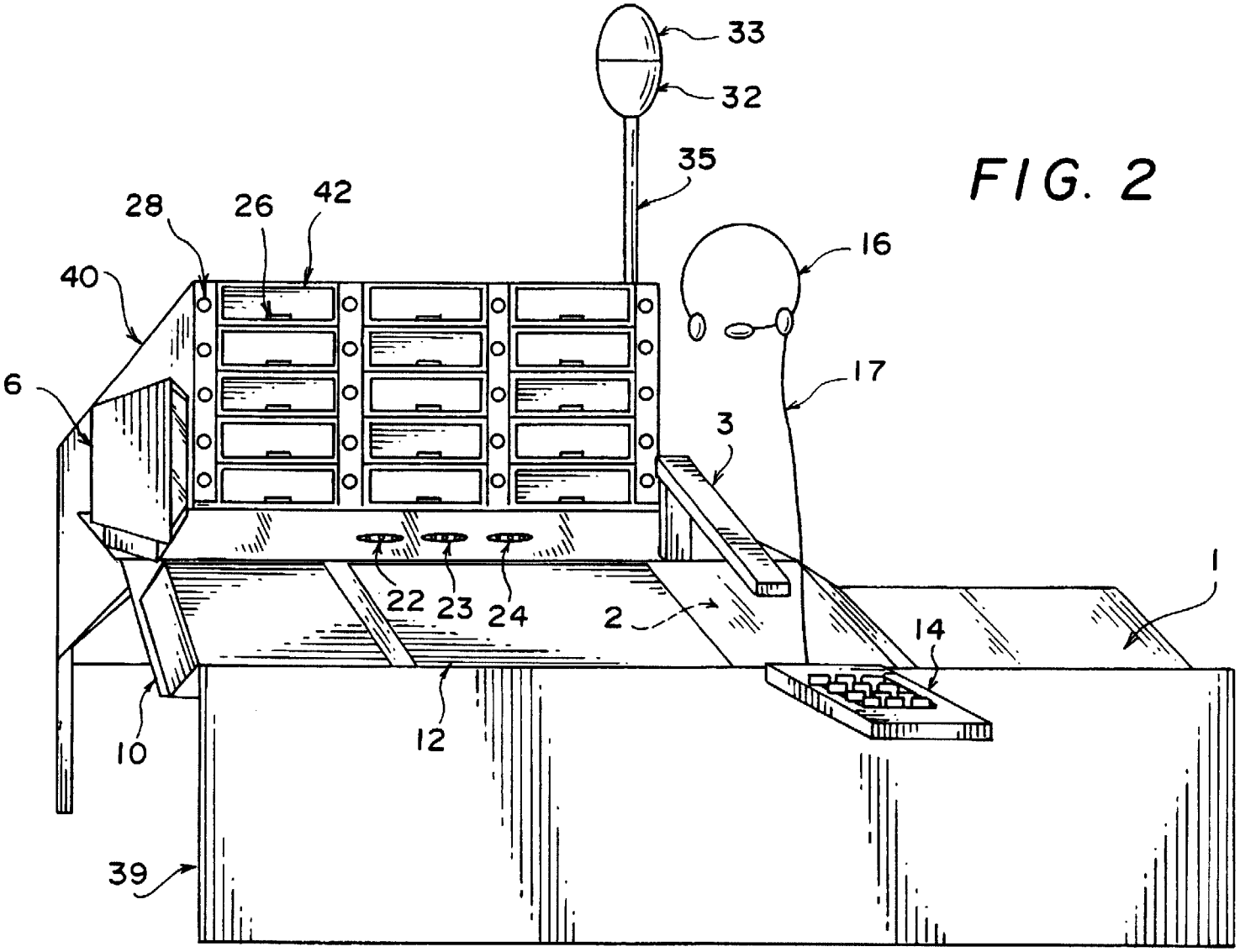
FIG. 2 is an illustration of a particular embodiment of the invention with 15 chutes, which is designed to induct incoming shipments at the point of initial entry, record shipment data, apply machine-readable data to shipments that lack such data, and conduct an initial sort on the shipment to prepare it or further processing.

FIG. 2 illustrates one configuration of the invention designed as an induction and initial sort station for flats and flat parcels. The device is designed to accommodate a range of shipment preparation levels. For example, a shipment prepared by a shipper using a computerized shipping system might contain all of the data needed to process and perform administrative functions on the shipment in a machine-readable format that would allow for efficient, expeditious handling. While the system could readily accommodate such a shipment, it is also capable of handling shipments that do not provide machine-readable data although this would require more human operator involvement.

As depicted, the device can be used:

- To scan a shipment for machine-readable data, including shipment-specific bar-code information and other shipper applied data, such as corporate account billing information, address data, shipment weight, and other shipper-provided data;

To enter shipment data not in machine readable form, such as address or shipment weight data;

To prepare and apply machine-readable labels to shipments that lack machine-readable data to facilitate downstream processing;

To perform a computer-controlled initial sort on the shipment and transport the shipment to another area/container for further processing;

To forward the shipment data to a central computer for use in administrative and managerial operations; and To check with the central computer for shipment specific processing instructions, such as in-transit shipment forwarding.

The device consists of an induction bin 1 which holds shipments awaiting induction and initial processing. The induction bin 1, contains an opening 2 for withdrawing shipments for induction and initial processing. A bar-code reader/image capture system 3 is located above the opening 2.

The bar-code reader/image capture system 3 is connected to the computer 4 by an interface cable 5 used to transmit data to/from the computer. The computer is connected to a computer monitor 6 by a standard video display cable 7, to a system control unit 8 by a parallel cable connection 9, to a printer 10 by a printer cable 11, and to an electronic scale 12 by a serial cable 13. The computer is also connected to a keyboard 14 by a keyboard cable 15, and to microphone/headset 16 by an audio input and output cable 17. As one goal of this configuration is to capture the shipment data and provide it to a central computer system, the computer is also connected to a computer network 18 by a network interface 19.

The system control unit 8 is, in turn, connected to a power supply 20 controlled by a power switch 21. The system control unit 8 is also connected to process status lights 22, 23, and 24 by wires 25 , to the chute gate enablers 26 by a parallel cable(s) 27, to the chute indicators 28 by a parallel cable(s) 29, to the chute/container sensors 30 by a parallel cable(s) 31, and to the system status lights 32 and 33 by wires 34. The system status lights 32 and 33 are located on top of a pole 35 to increase the visibility of the system status lights. If the induction and initial sort station will be required to handle stamped or postal metered shipments, the unit can be equipped with a postage canceler 36, monitored by a cancellation detector 37 connected to the control unit 8 by wires 38. The system control unit 8 and the computer 4 are contained in a cabinet under the workstation structure 39, which is designed to provide an ergonomic placement of the other system components.

On top of the workstation structure 39 is a chute sort structure 40, which contains fifteen chutes 41 which are each approximately three inches high and twelve inches wide. The chute sort structure 40 also contains the chute gate enablers 26, which enable (unlock) or lock (the default position) the individual chute gates 42 to control sorting. The chute sort structure 40 also contains the chute indicators 28, the chute sensors 30, and part of the wiring associated with 26, 28 and 30.

Under a typical operating pattern for the configuration of the invention illustrated in FIG. 2, the process would proceed as follows:

Step 1. The system operator logs into the system by entering his personal identification code on the keyboard 14 and/or entering his or her voice pattern through the microphone/headset 16. The system then proceeds to step 2.

Step 2. The computer 4 signals the system controller 8 to turn on the system active status light 32, and also sends a signal to the monitor 6 to display a "remove shipment from induction bin" action request. The operator then proceeds to step 3.

Step 3. The system operator removes the shipment through the opening 2 in the induction bin 1. The system then proceeds to step 4.

Step 4. The shipment passes under the bar-code scanner/image capture system 3, which scans the shipment for machine-readable data. The system then proceeds to step 5.

Step 5. If the computer successfully read the shipment address information (and any other machine-readable shipment information), and if the address is valid, the computer forwards the information to the computer network 18 via the network interface 19 and then proceeds to step 13. Otherwise the computer proceeds to step 6.

Step 6. The computer sends a signal to the system controller 8 to light the address entry process status light 22 and also sends a signal to the monitor 6 to display an "address entry" information request to the operator. The operator then proceeds to step 7.

Step 7. The operator checks the shipment for machine-readable data. If the shipment has machine-readable data, the operator re-scans the package under the bar-code reader/image capture system 3, and the process returns to step 4. However, if the shipment does not have machine-readable data, the process continues to step 8.

Step 8. The operator reads the shipments zip code and street address into the microphone/headset 16, the system then proceeds to step 9. Alternately, the operator could proceed directly to step 11, and manually enter the data.

Step 9. The computer analyzes the voice data using voice recognition software to generate an address. The computer then compares the address information with an address database to check if the address is valid. If the voice entry is successful and the address is valid, the computer 4 sends a signal to the computer monitor 6 to display the address, and repeats the address to the operator over the microphone/headset 16. If the address entry was incorrect or was not recognizable, the computer proceeds to step 10. If the address was correctly input, the computer proceeds to step 12.

Step 10. The computer sends a signal to the computer monitor 6 to display a "repeat address entry" information request. The operator can then either repeat step 9 using voice input or proceed to step 11.

Step 11. If the operator is unable to enter a valid address using voice recognition, the operator will use the computer keyboard 14 to enter the data, entering the zip-code, followed by the street address and the first few letters of the street name, at which point the computer will use a look-up program to reduce the number of key-strokes required by the operator to the street address and the first few letters of the street (if there are several street names with the same initial letters the computer will display a list). The computer 4 will then compares the address information with an address database to check if the address is valid. If the address is valid, the computer 4 will send a signal to the computer monitor 6 to display the address, and will repeat the address to the operator over the microphone/headset 16. If the address entry was incorrect, the operator repeats step 11. Once the system has a valid address, the system will proceed to step 12.

Step 12. The computer 4 sends a signal to the system controller 8 to turn-off the address entry process status light 22, and sends a signal to the monitor 6 to clear the display.

If the shipment did not have machine-readable data, the shipment will print a machine-readable label to attach to the package to facilitate downstream processing. The system then proceeds to step 13.

Step 13. The system transmits the shipment data to the computer network 18 via the network interface 19. If the shipment being processed requires weighing, the computer 4 will send a signal to the computer monitor 6 to display a "weigh shipment" information request for the operator, who will then slide the shipment onto the electronic scale 12, which will transmit the required shipment weight data to the computer 4. The system then proceeds to step 14.

Step 14. If the computer received valid billing information in machine-readable form during step 4 or 7, the computer will proceed to step 21. If the computer did not receive valid billing information, the system will proceed to step 15.

Step 15. The computer sends a signal to the system controller 8 to light the billing information request status light 23 and also sends a signal to the monitor 6 to display a "billing data" information request to the operator. The operator then proceeds to step 16.

Step 16. The operator checks the package for billing information, stamps, or postal indicia. The operator then proceeds to step 17.

Step 17. The operator notifies the computer 4 of the billing method and enters payee data if necessary via voice input on the microphone/headset 16 or keyboard 14. If the shipment is stamped or postal metered, the operator also cancels the postage on the postage canceler 36, which triggers the cancellation detector 37, alerting the computer that the billing process has been completed. The system then proceeds to step 18.

Step 18. The computer 4 sends a signal to the system controller 8 to turn-off the billing information request process status light 2 and also sends a signal to the monitor 6 to clear the display. The system then proceeds to step 19.

Step 19. The computer 4 compares the shipment destination address information to the destination address database to determine the appropriate destination chute, and checks to see if there are any special processing instructions for that particular package. The system then proceeds to step 20.

Step 20. The computer 4 sends a signal to the system controller 8 to turn-on the sort shipment now process status light 23 and also sends a signal to the monitor to display a "sort package now" action request which also indicates the appropriate chute. The computer also transmits a signal to the system controller 8 to light the appropriate chute indicators 28 and to activate the appropriate chute gate enablers 26. The operator then proceeds to step 21.

Step 21. The operator places the shipment in chute designated by the lit chute indicators 28, which is also the only chute 41 with a gate 42 that is unlocked by the chute gate enablers (may also be called a gate opener) 26. The process continues in step 22.

Step 22. The shipment slides down the chute and triggers the chute sensor 30 which sends a signal to the system controller 8, which relays the signal to the computer 4. The signal indicates that the sortation was completed. This causes the system to proceed to step 23.

Step 23. Once the sortation is completed, the computer 4 transmits any additional shipment data to the computer network 18 via the network interface 19.

Step 24. The computer 4 sends a signal to the system controller 8 to turn-off the sort shipment now status light 24 and also sends a signal to the monitor to clear the "sort package now" action request. The computer 4 and operator return to step 2 until all pieces have been sorted or the shift is over-unless there are no more shipments to sort. If there are no more shipments to sort, the operator can place the system in stand-by mode, in which case the process will proceed to step 25.

Step 25. If all pieces have been sorted and the package sort shift is still ongoing, the operator notifies the computer 4 tells via voice input on the microphone/headset 16 or keyboard 14 that he is awaiting shipments. The computer 4 then sends a message to the system controller 8 to light the awaiting shipment light 33.

Step 26. If the operator's shift is over, the operator logs out of the system via voice input on the microphone/headset 16 or keyboard 14. The computer 4 then sends a message to the system controller 8 to turn of the system status lights 32 & 33, which indicates that the induction station is no longer operational.

Because of its location in the shipment status process, several variations on the induction and initial sort station are possible. Because sort errors would be infrequent even without the use of chute gates 42 and gate enablers 26, and because shipments will be processed and resorted at the next step, the gates 42 and gate controllers 26 could be eliminated to reduce induction and initial sort station complexity. Another modification is that, while the other preferred configurations of the invention would normally sort into a container or bin 48, since the induction and initial sort station would normally be directly feeding other primary and secondary sort operations, the chutes 41 might flow directly to the induction bin of the other operations, or else could feed a conveyer belt that fed these operations. As such, the material handling components of the induction and initial sort station can be simpler than those used in other variations of the invention.

Figure 3:
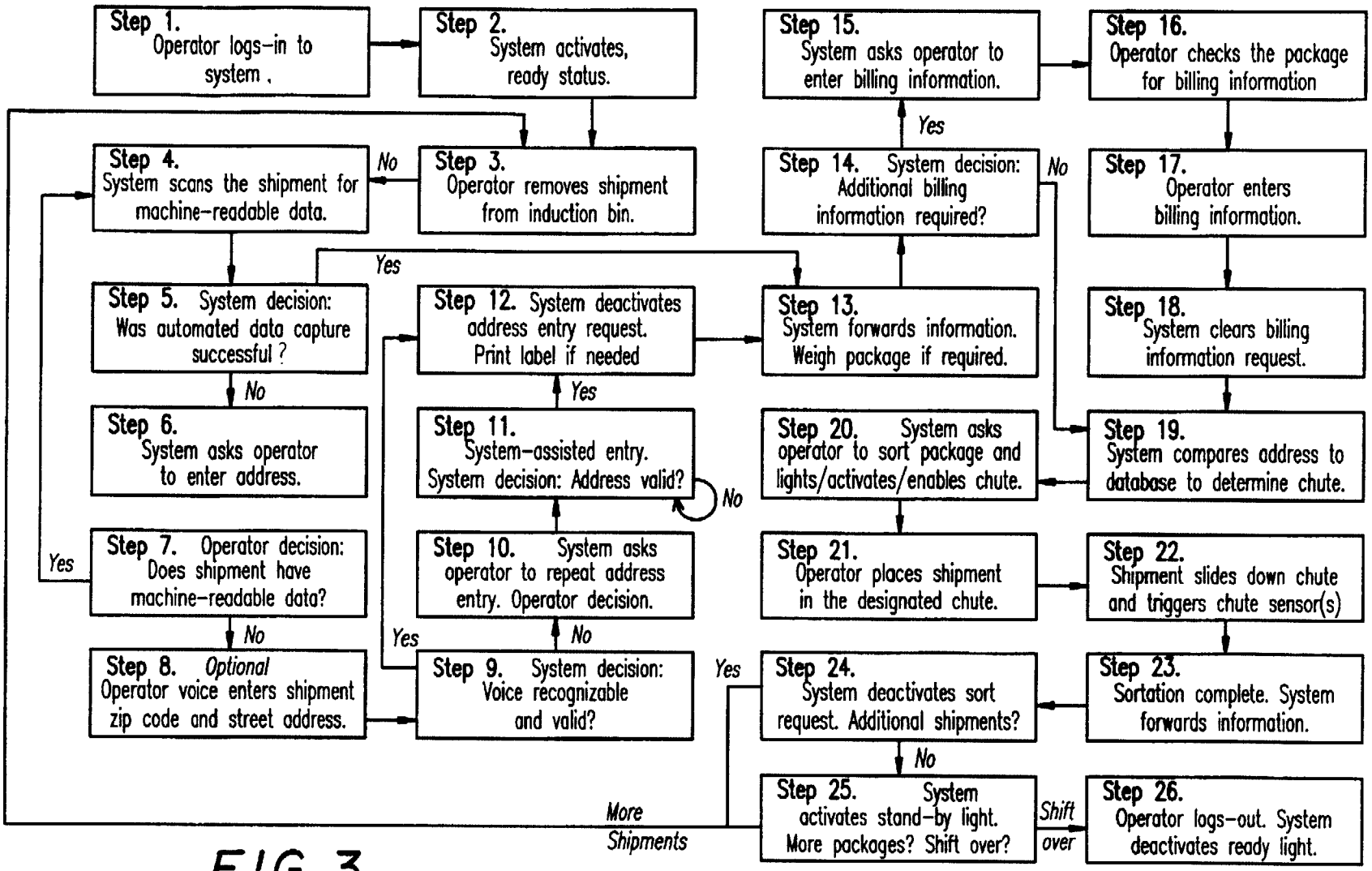
FIG. 3 is an illustration of the operational flow-chart for the embodiment shown in FIG. 2.

FIG. 3 is a graphic illustration of 26 step operational process outlined under the discussion of FIG. 2 operations.

Figure 4:
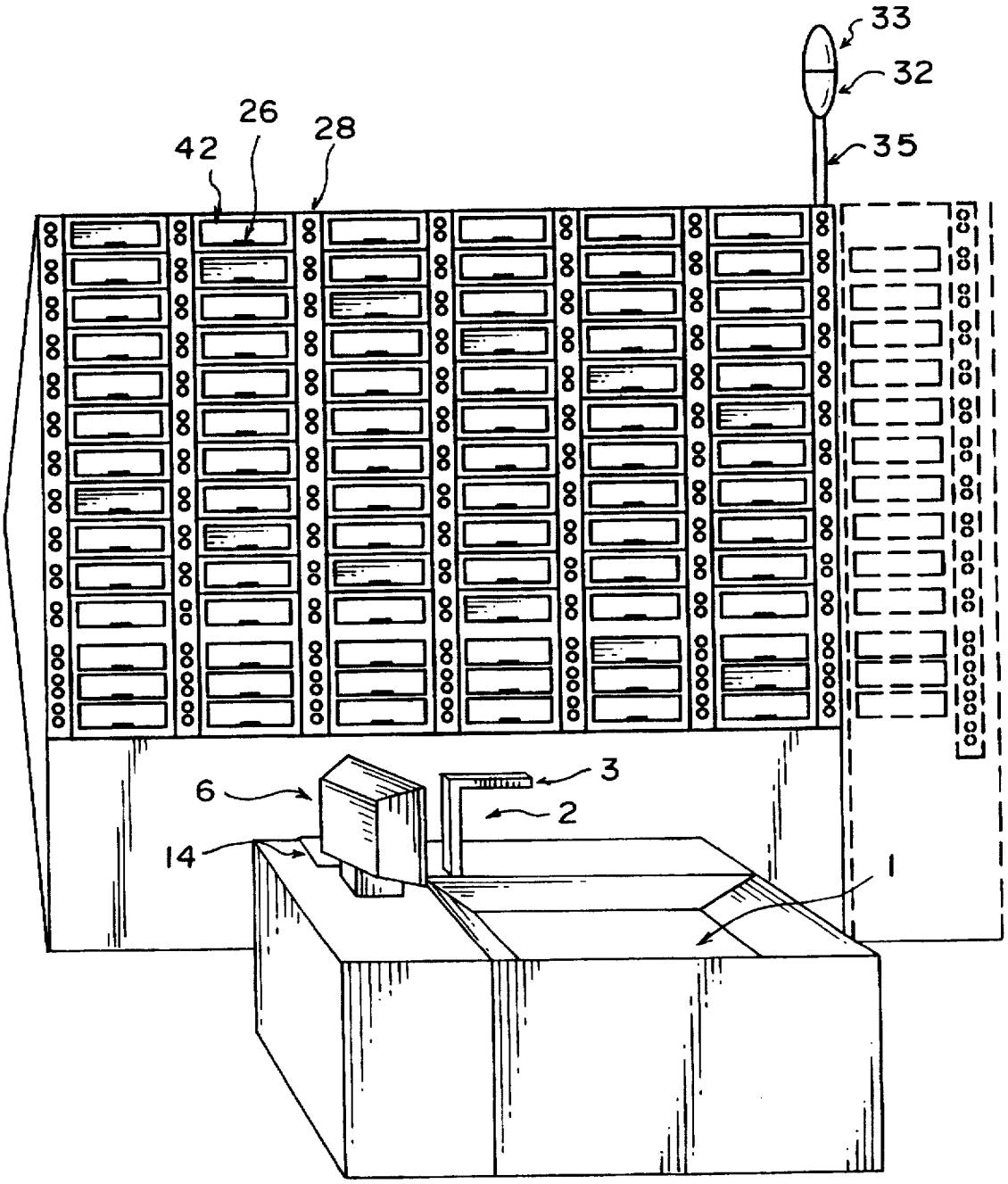
FIG. 4 is an illustration of a particular embodiment of the invention incorporating 84 chutes designed for flat sorting and depicting the entrance to the chutes, the gates, and the workstation layout.

FIG. 4 is an illustration of a particular embodiment of the invention incorporating 84 chutes designed for sorting flats that have already been processed by a system such as the shipment induction station illustrated in FIG. 2. Because all pieces processed by the system should have valid machine-readable data, and because the primary function of the system is sorting (and not shipment induction), the device contains more chutes and has fewer ancillary devices than the shipment induction configuration illustrated in FIG. 2.

The device consists of an induction bin 1 which holds shipments awaiting induction and initial processing. The induction bin 1, contains an opening 2 for withdrawing shipments for induction and initial processing. A bar-code reader/image capture system 3 is located above the opening to automatically scan packages as they are removed from the induction bin, and is connected to the computer 4 by an interface cable 5 used to transmit data to/from the computer. The computer is connected to a computer monitor 6 by a standard video display cable 7 and to a system control unit 8 by a parallel cable connection 9. The computer is also connected to a keyboard 14 by a keyboard cable 15. As a primary goal of the operation of this configuration of the invention is to capture the shipment data and provide it to a central computer system, the computer is also connected to a computer network 18 by a network interface 19.

The system control unit 8 is, in turn, connected to a power supply 20 controlled by a power switch 21. The system control unit 8 is also connected to process status lights 22, 23, and 24 by wires 25 , to the chute gate controller 26 by a parallel cable(s) 27, to the chute indicators 28 by a parallel cable(s) 29, to the chute sensors 30A and container sensors 30B by a parallel cable(s) 31[3], and to the system status lights 32 and 33 by wires 34. The system status lights 32 and 33 are located on top of a pole 35 to increase the visibility of the system status lights.

[3]While there are several options for the sensors, including electromechanical, pressure pads, and photo-gates. The standard sensor envisioned here is a photo-gate, consisting of a photo-emitter and a photo-detector, which is intermittently scanned by the controller such that the time between scans is less than the time required for a package to pass by. The controller looks for a drop-in the amount of current passing through the photo-detector, which indicates that the light beam has been interrupted. A prolonged drop-off would indicate a jam, sensor failure, or full container (depending on the type of sensor deployment.)

The chute sort structure 40 contains multiple chutes 41 large enough to accommodate the shipments to be sorted. The chute sort structure 40 also contains the chute gate controller 26, which controls the individual chute gates 42, which are located at the entrance to the chutes 41 and are designed to block the chutes 41 when in a down position. This allows the computer to control sorting by physically preventing shipments from being placed in the wrong chute. The chute sort structure 40 also contains the chute indicators 28, the chute/container sensor 30, and part of the wiring associated with 26, 28 and 30.

At the bottom of each chute is a container or bin 43 which holds the sorted shipments. A chute sensor 30A is located at the end of the chute to detect shipments entering the container. A container sensor 30B is positioned so that, when the container or bin nears capacity the shipments in the container/bin will continuously block the container sensor 30B. This allows the computer 4 to determine when the container or bin 43 needs to be replaced or emptied. When the computer 4 detects that a container or bin 43 is nearing capacity, the computer 4 sends a signal to a container status light 44, which is located near the container or bin 43 that needs to be replaced or emptied, and is connected to the system controller 8 by a wire or cable 45. When the operator or another individual is ready to replace or empty the container or bin, he or she will remove or empty the container or bin.

The process of removing or emptying the bin will automatically deploy a chute blocker 46 located at the bottom of the chute 41, blocking any shipments sorted into the chute 41 at the bottom of the chute 41 until after the container or bin is replaced or emptied, lowering the chute blocker 46, allowing the shipments to flow into new or empty containers or bins. The chute blocker 46 is monitored by a container change sensor 47, which is connected to the system controller 8 by an cable or wire 48. Since the chute blocker 46 deploys when the container or bin 43 is emptied, which triggers the container change sensor 47, the computer 4 is able to determine the particular container 43 or unload batch (from a bin 43) an individual shipment is in, even if the shipment was sorted at roughly the same time as the container/bin was replaced or emptied. This facilitates shipment information management. To further facilitate shipment information management, a container label holder 49 is placed near each container/bin 43 with labels 50 specific to that container/bin 43, and with each label sequentially numbered or ordered. By applying the next label in sequence to the removed container 43 or to the shipment consolidation container used to empty the bin 43, the computer 4 can associate all of the shipments in the container or bin 43 with a specific container label, enabling downstream shipment tracking.

Under a typical operating pattern for the configuration of the invention illustrated in FIG. 4, the process would proceed as follows:

Step 1. The system operator logs into the system by entering his personal identification code on the keyboard 14. The system then proceeds to step 2.

Step 2. The computer 4 signals the system controller 8 to turn on the system active status light 32, and also sends a signal to the monitor 6 to display a "remove shipment from induction bin" action request. The operator then proceeds to step 3.

Step 3. The system operator removes the shipment through the opening 2 in the induction bin 1. The system then proceeds to step 4.

Step 4. As the shipment passes under the bar-code scanner/image capture system 3, the system scans the shipment for machine-readable data.

Step 5. If the computer successfully read the shipment address information (and any other machine-readable shipment information), and if the address is valid, the computer forwards the information to the computer network 18 via the network interface 19 and then proceeds to step 10. Otherwise the system proceeds to step 6.

Step 6. The computer sends a signal to the system controller 8 to light the address entry process status light 22 and also sends a signal to the monitor 6 to display an "address entry" information request to the operator. The operator then proceeds to step 7.

Step 7. The operator re-scans the package under the bar-code reader/image capture system 3, and the process returns to step 5. If the shipment does not have machine readable data, the system proceeds to step 8. If the data capture was successful and the address is valid, the system proceeds to step 9.

Step 8. The system lights a return chute which will transport the shipment to an induction and initial sort station, such as the one indicated in FIG. 2, for reprocessing. The operator then proceeds to step 12

Step 9. The computer 4 sends a signal to the system controller 8 to turn-off the address entry process status light 22 and also sends a signal to the monitor 6 to clear the display. The system then proceeds to step 10.

Step 10. The computer 4 compares the shipment destination address information to the destination address database to determine the appropriate destination chute and forwards the shipment data to the computer network 18 via the network interface 19. The system then proceeds to step 11.

Step 11. The computer 4 sends a signal to the system controller 8 to turn-on the sort shipment now process status light 23 and also sends a signal to the monitor to display a "sort package now" action request which also indicates the appropriate chute. The computer also transmits a signal to the system controller 8 to light the appropriate chute indicators 28 and to activate the appropriate chute gate enablers 26. The operator then proceeds to step 12.

Step 12. The operator places the shipment in chute designated by the lit chute indicators 28, which is the only chute 41 which will not be physically blocked by a gate 42. The process then proceeds to step 13.

Step 13. The shipment slides down the chute and triggers the chute sensor 30 which sends a signal to the system controller 8, which relays the signal to the computer 4. The signal indicates that the sortation was completed. The system then proceeds to step 14.

Step 14. Once the sortation is completed, the computer 4 transmits any additional shipment data to the computer network 18 via the network interface 19, and then proceeds to step 15.

Step 15. The computer 4 sends a signal to the system controller 8 to turn-off the sort shipment now status light 24 and also sends a signal to the monitor to clear the "sort package now" action request. The computer 4 and operator return to step 2 until all shipments have been sorted. If there are no more shipments, the operator can place the system in a stand-by mode, moving the process onto step 16.

Step 16. If all pieces have been sorted and the package sort shift is still ongoing, the operator notifies the computer 4 tells via keyboard 14 that he is awaiting shipments. The computer 4 then sends a message to the system controller 8 to light the awaiting shipment light 33. If more shipments are later sent to the station, the operator can take the system out of stand-by mode, and proceed to step 3. If the operator's shift ends, the operator will proceed to step 17.

Step 17. If the operator's shift is over, the operator logs out of the system via voice input on the microphone/headset 16 or keyboard 14. The computer 4 then sends a message to the system controller 8 to turn of the system status lights 32 & 33, which indicates that the induction station is no longer operational.

Figure 5:
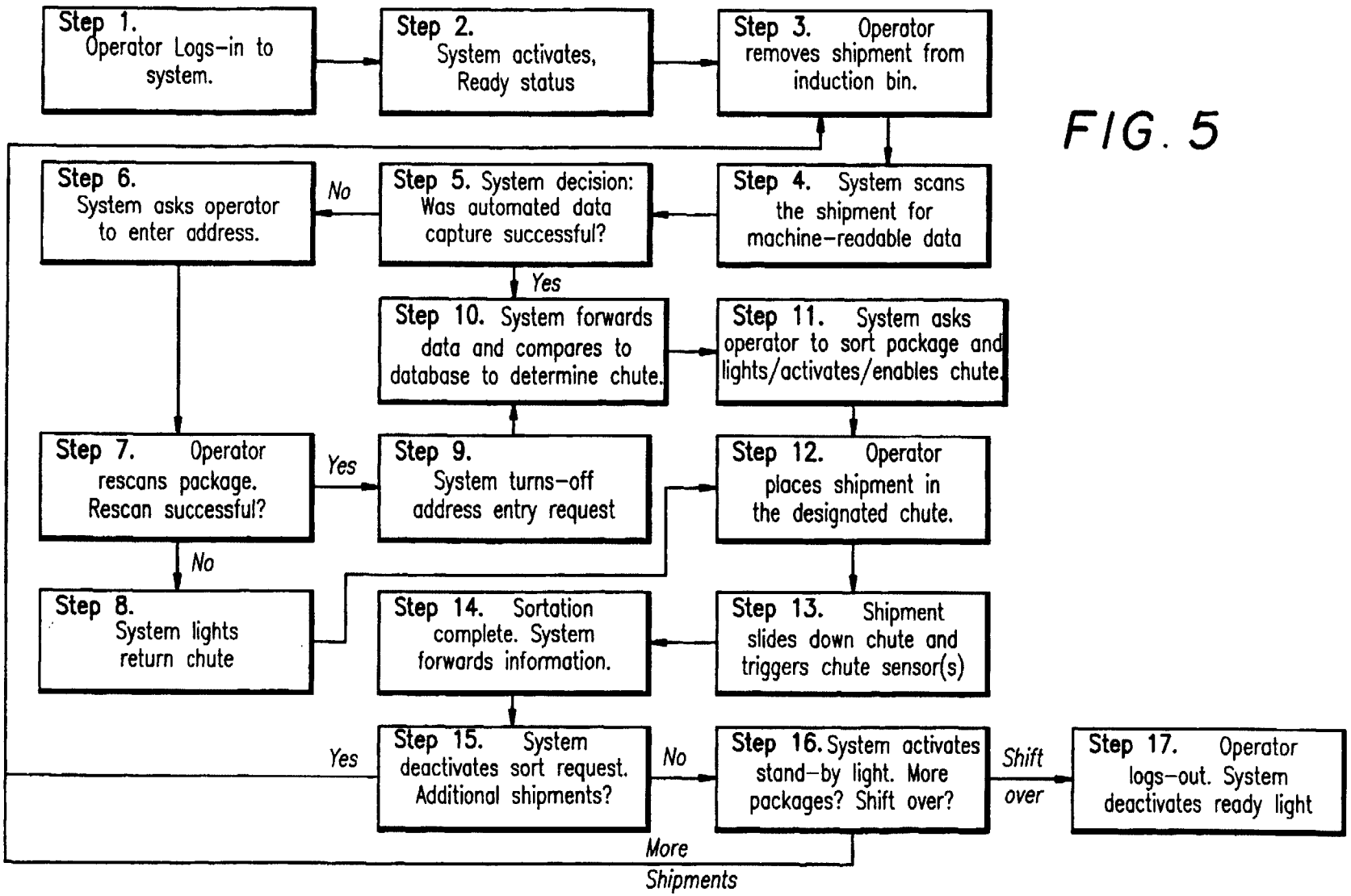
FIG. 5 is an illustration of the operational flow-chart for the embodiment shown in FIG. 4.

FIG. 5 is a graphic illustration of the 17 step operational process outlined under the discussion of FIG. 4 operations.

Figure 6:
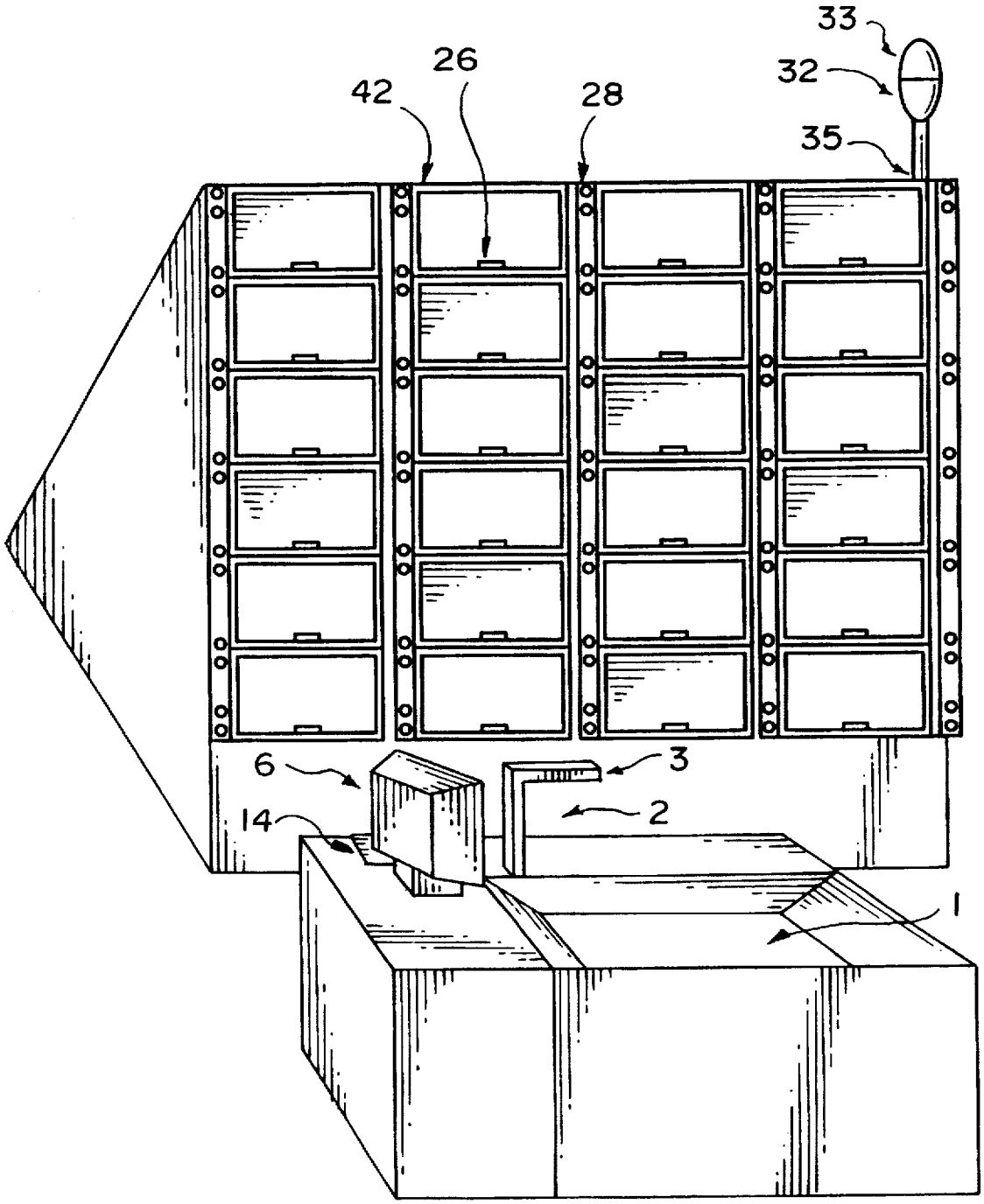
FIG. 6 is an illustration of a particular embodiment of the invention incorporating 20 chutes designed for parcel sorting and depicting the entrance to the chutes, the gates, and a sample workstation layout.

FIG. 6 is an illustration of a particular embodiment of the invention incorporating 24 chutes designed for parcel sorting and depicting the entrance to the chutes, the gates, and a sample station layout. The particular embodiment displayed in FIG. 6 is essentially identical to that displayed in FIG. 4, except that the chutes and gates are designed to accommodate small to medium parcels. As a result, the chutes are approximately 10" high and 18" wide. Since each chute requires more space than the chutes illustrated in FIG. 4, the unit shown contains only 24 chutes, although an actual sort station might include several units arrayed in an L-shape or a u-shape. The figure's component number correspond to the numbers discussed in FIG. 4 above.

Figure 7:
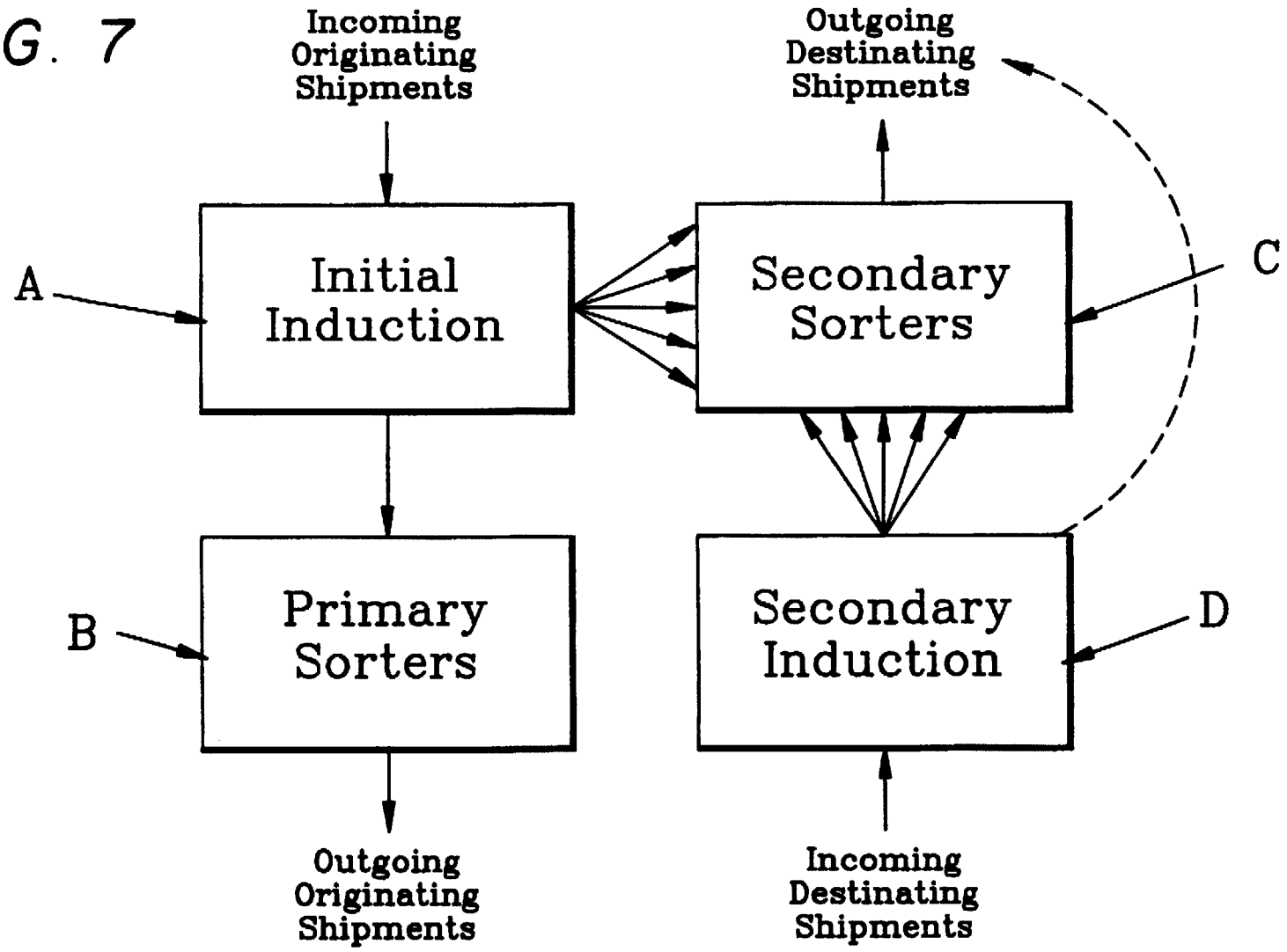
FIG. 7 is a process illustration for a sample facility layout combining multiple semi-automated integrated sort systems into a primary and secondary sort configuration supported by integrated shipment induction units.

FIG. 7 is a process illustration for a sample facility layout combining multiple semi-automated integrated sort systems into a primary and secondary sort configuration supported by integrated shipment induction units.

Incoming originating shipments that were collected from local facilities or shippers, and have not been processed yet are transported to the induction station(s) A, which are similar to the configuration depicted in FIG.2. The shipments are then processed and sorted to a primary sorter(s) B, which is similar to the configuration depicted in FIG. 4 and sorts shipments to another processing facility for secondary sortation, or else are sorted directly to a secondary sorter(s) C which is similar to the configuration depicted in FIG. 4 and sorts shipments for local distribution. If the number of local sort separations required exceeds the number of slots, multiple secondary sorters C could be used with different addresses.

A variation on the secondary sorter C is the secondary induction sorter D. In the event that there are more local sort separations than a single sorter can manage, the secondary induction sorter(s) D can be given the highest volume local separations so that a disproportionate number of shipments can be handled with a single sort at the designating facility. Remaining lower volume local separations would be handled by sorting to a secondary sorter C.

The various components A, B, C, & D could be connected with a mix of chutes and conveyers. As can be seen in even this simple example, there are many possible configurations of the device. The flexibility and integration capabilities of the device provide a powerful means of shipment handling.

Figure 8:
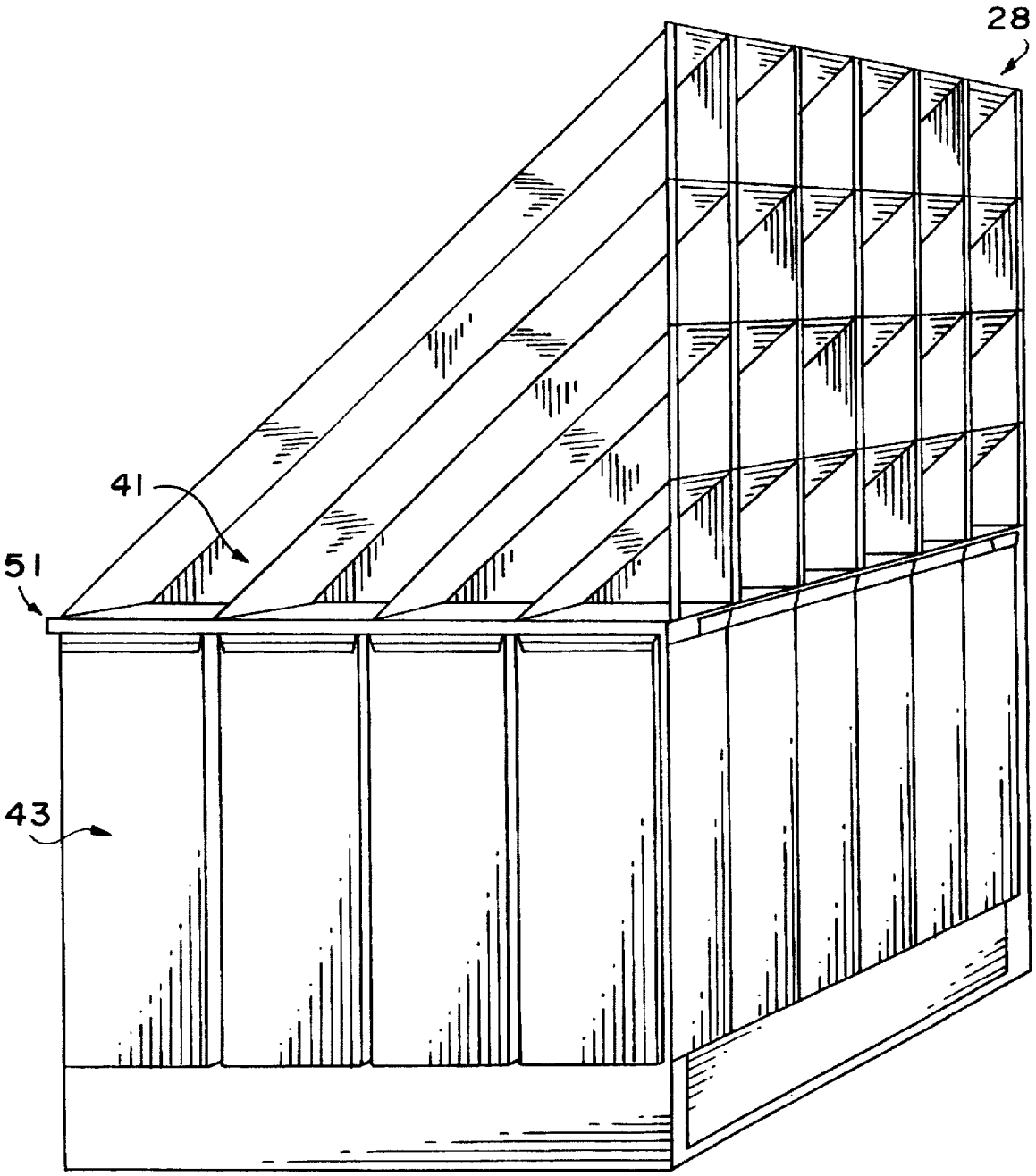
FIG. 8 is a cut-away illustration of a particular embodiment of the invention with 24 chutes directly feeding sacks or small containers that is designed for a more manual, less-integrated operation, such as might be deployed at a central processing facility that does not require integrated information management.

FIG. 8 is an illustration of a particular embodiment of the invention with 24 chutes designed to require less space than a full system, and that is well-suited for a less data-intensive small parcel sorting operation, such as might be deployed at a central processing facility that does not require integrated information and process management. The device chutes are square roughly 12" by 12", and angle downwards at a 45 degree angle, feeding into individual sacks or containers. The chutes array rests on top of an array of sacks or containers, supported in a structure. The device consists of a data entry system (not shown), which is used to illuminate chute indicators 28. Since the illustrated manifestation of the device is designed to sort shipments that do not require extremely reliable service, the illustrated embodiment does not contain a chute gate to block access to the chutes, or a means to readily correct a mis-sort. The system would contain chute/container status sensors 30, located at the bottom of the chutes 41, so that when a container 43 was full, the shipments in the container would block the chute/container status sensors 30 continuously. The computer would then alert the operator to replace a container. This could be readily accomplished by folding the chute structure up about a pivot 51, providing ready access to the full container 43. While the illustrated embodiment would not be able to prevent a mis-sort, the system would be capable of tracking operator sort accuracy, and of simplifying the sort process, so that mis-sorts should be comparatively rare.

Figure 9:
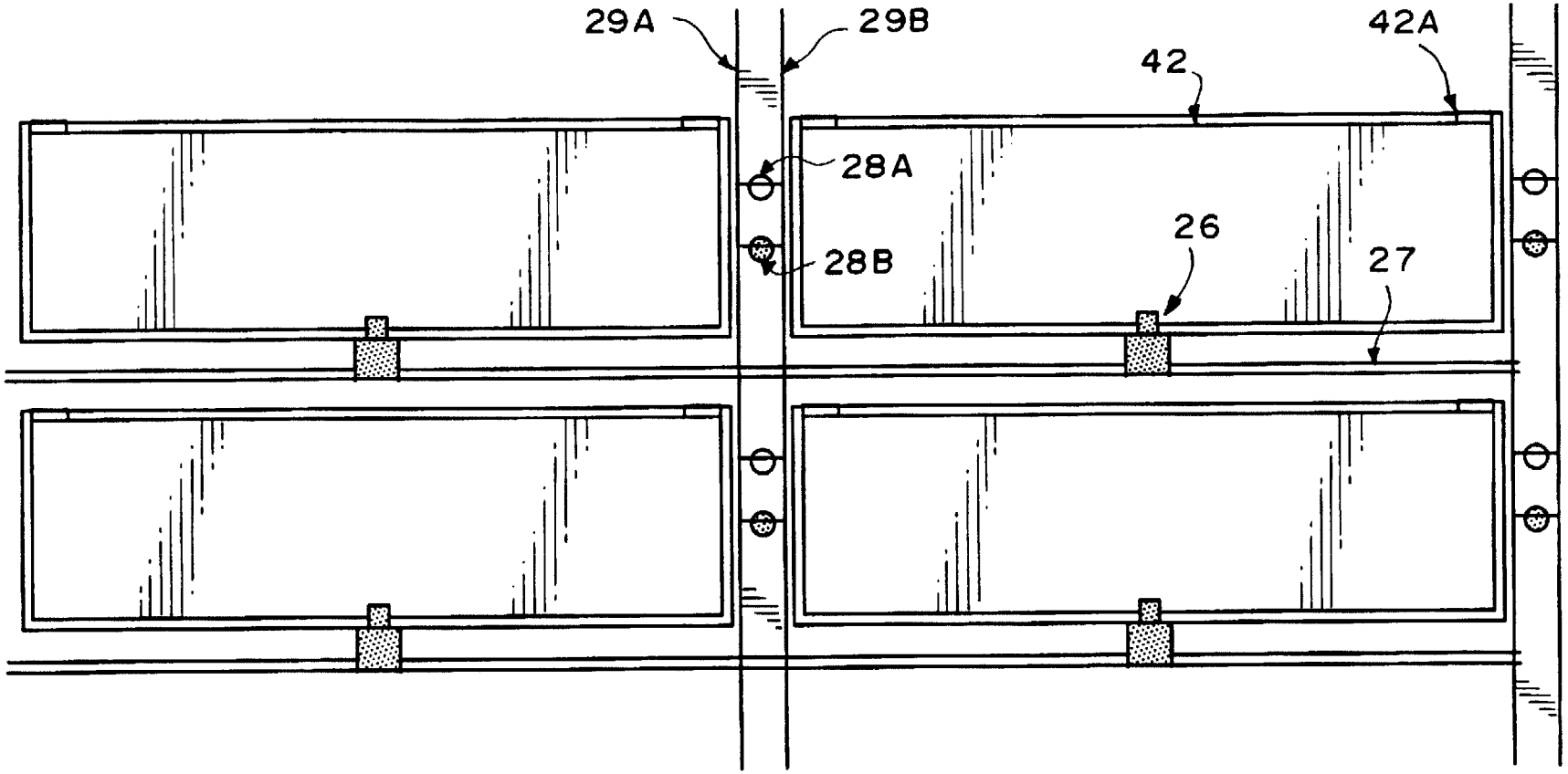
FIG. 9 is an illustration of one configuration for the computer-enabled chute gates.

FIG. 9 is an illustration of one configuration for the computer-enabled chute gates. The gate 42 swings on hinges 42A into the chute 41. The gate controller 26 is a spring-loaded solenoid such that the normal position of the solenoid is deployed (sticking up). When the gate controller 26 is in the up position, it prevents the gate 42 from swinging inwards, thus blocking the chute. When the gate controller 26 receives an electric current through the wires 27, the solenoid withdraws into the enabler, allowing the gate to swing freely so that a shipment can be inserted through the gate 42 into the chute 41. On either side of the gate 42 are chute indicators 28, which are connected to the system controller 8 by wires 29. In this illustration, there are two chute indicators 28A and 28B with different colors. When the chute indicators 28 receive an electric current via the wires 29, the indicators illuminate. Each indicator 28 has a unique circuit path, and is individually controllable by the controller 8. Under normal operation, the indicators on either side of the chute 41 that the shipment should be placed in would be illuminated, and the chute enabler 26 would be activated. In this example indicators 28 or two colors are used so that two operators can operate the system at a time by assigning each operator a specific color of indicator 28.

A variation of the mechanism displayed in FIG. 9, is to place the gate mechanism behind a chute sensor that can detect when a shipment is inserted into the chute. This arrangement allows the normal position of the gate controller 26 to be unlocked. The gate controller 26 would be locked only if the gate 42 was not on the correct chute, and the chute sensor 30 detected a package (i.e., the operator was attempting to sort into the wrong chute). This would reduce the number of times the gate controller 26 was required to operate, reducing wear and tear.

Figure 10:
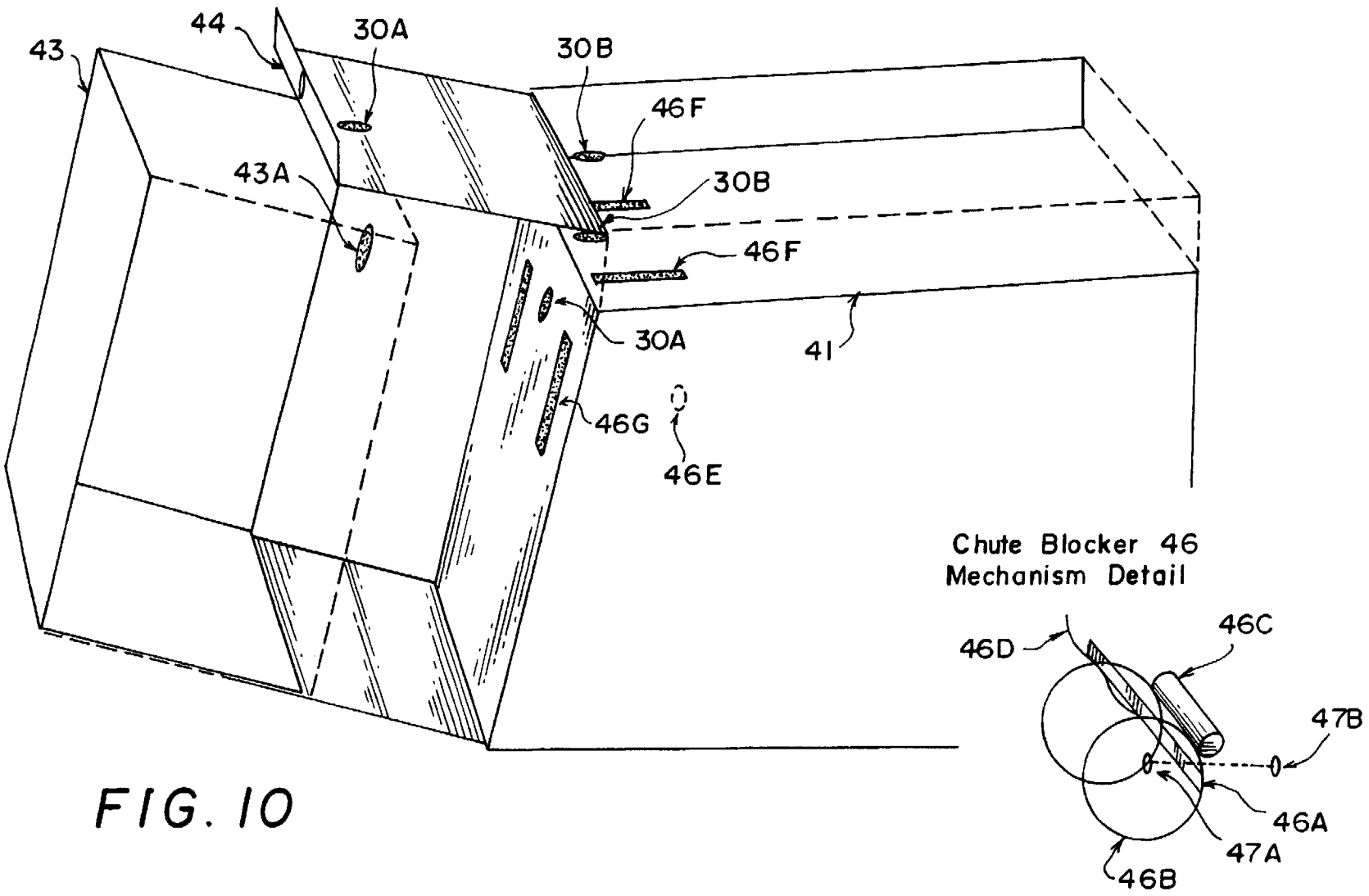
FIG. 10 is an illustration of a flat consolidation container, chute, and chute sensor design.

FIG. 10 is an illustration of a flat consolidation container design and its deployment in the material handling system to allow sensors to monitor shipment and container status. In the illustration the container 43 is inserted into the structure, aligning the top of the container 43 and the end of the chute 41. This also aligns a cut-out 43A in the container 43, with one container sensor 30A in the container sensor 30A pair so that the upper container sensor 30A can receive a light beam emitted by the lower container sensor 30A unless a shipment is blocking the opening 43A, which would correspond to a container full status. When the container 43 is full, this triggers the container status detector 30A, alerting the computer 4 via the system controller 8 that the container 43 needs to be replaced. The computer then illuminates a container status indicator 44 indicating that the container 43 needs to be replaced. The operator then removes the container 43. This activates the chute blocker 46. The chute blocker 46 rotates about the chute blocker axis 46A which rests in the pivot point 46E. The chute blocker 46 is rotated by a weight 46C to the right of the pivot point. This causes the resting container "detector" 46B to slide through the slots 46G in the side of the structure, and the chute blocker gate 46 D to slide through the slots 46F in the chute 41, blocking the chute. As the chute blocker 46 rotates it triggers the container change detector 47B which activates when the chute blocker is in a deployed position. This allows the computer 4 to determine that the container 43 is being replaced and the that the chute blocker 46 is deployed. Since the chute sensor 30B is located after the chute blocker 46, the computer 4 can determine whether a shipment is in a given container 43, or was caught by the chute blocker 46. Replacing the container 43 places pressure on the container "detector" 46B, causing the chute blocker 46 to rotate into a stowed position, and causing the container change detector 46B to detect that the container 43 has been replaced.

Figure 11:
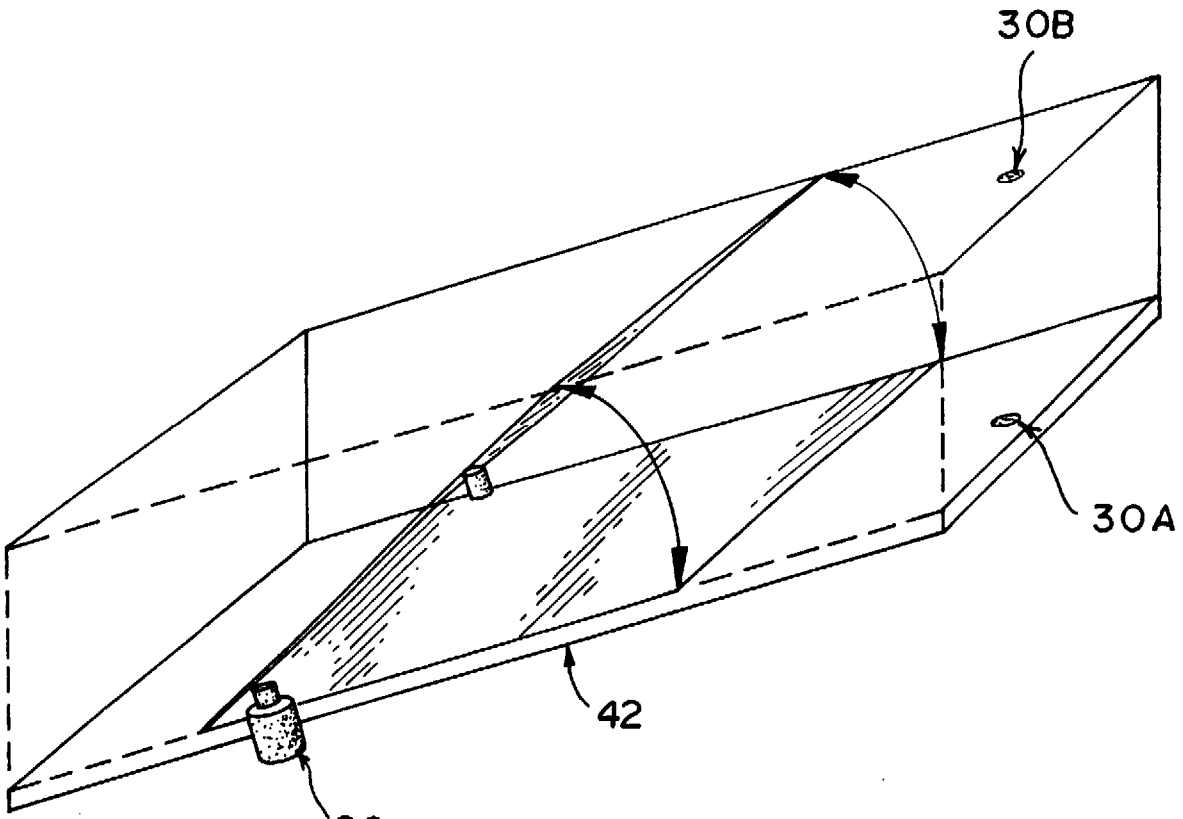
FIG. 11 shows an alternate design for the gate to prevent mis-sorts, using a computer controlled gate beyond the initial entrance, and behind a chute sensor, where the gate only activates in the event of a mis-sort.

FIG. 11 shows an alternate design for the gate. In this drawing, the gate 42, is controlled by an electrically-controlled gate controller 26, such as a solenoid or electromagnet. The gate is placed approximately a short distance inside the chute 41. In its default position the gate is deployed in a down position and the chute 41 is open. When a shipment is inserted into the chute 41 it breaks a light beam emitted by the emitter 30A, so that the beam cannot be detected by the detector 30B. As the signal from the emitter-detector pair would be transmitted via a system controller 8 to a computer 4, the computer software would be able to detect that a shipment had been inserted into the chute 41. If this chute was not the correct chute, the computer 4 would direct the system controller 8 to send an electrical current to the gate controller 26 causing the gate 42 to deploy and block the chute 41.

This would prevent the shipment from sliding down the chute 41, and would allow the operator to retrieve the shipment and insert it into the correct chute. This provides some advantages over the chute gate mechanism displayed in FIG. 9 in that the gate actuator only needs to be activated in the event of an operator error. Reducing the frequency of actuator operations should prolong device life and simplify device operation. However, because the gate would have to operate rapidly, and would have to be physically moved by the gate controller (as opposed to merely unlocked), this approach would require a more powerful, more expensive actuator, and would complicate operations in some respects. As a result, selection of a gate mechanism such as that shown in FIG. 9 and FIG. 11, or of an alternate mechanism, such as a computer-opened gate, or even the absence of a gate mechanism, will be a reflection of the specific operational requirements on the system.

Figure 12:
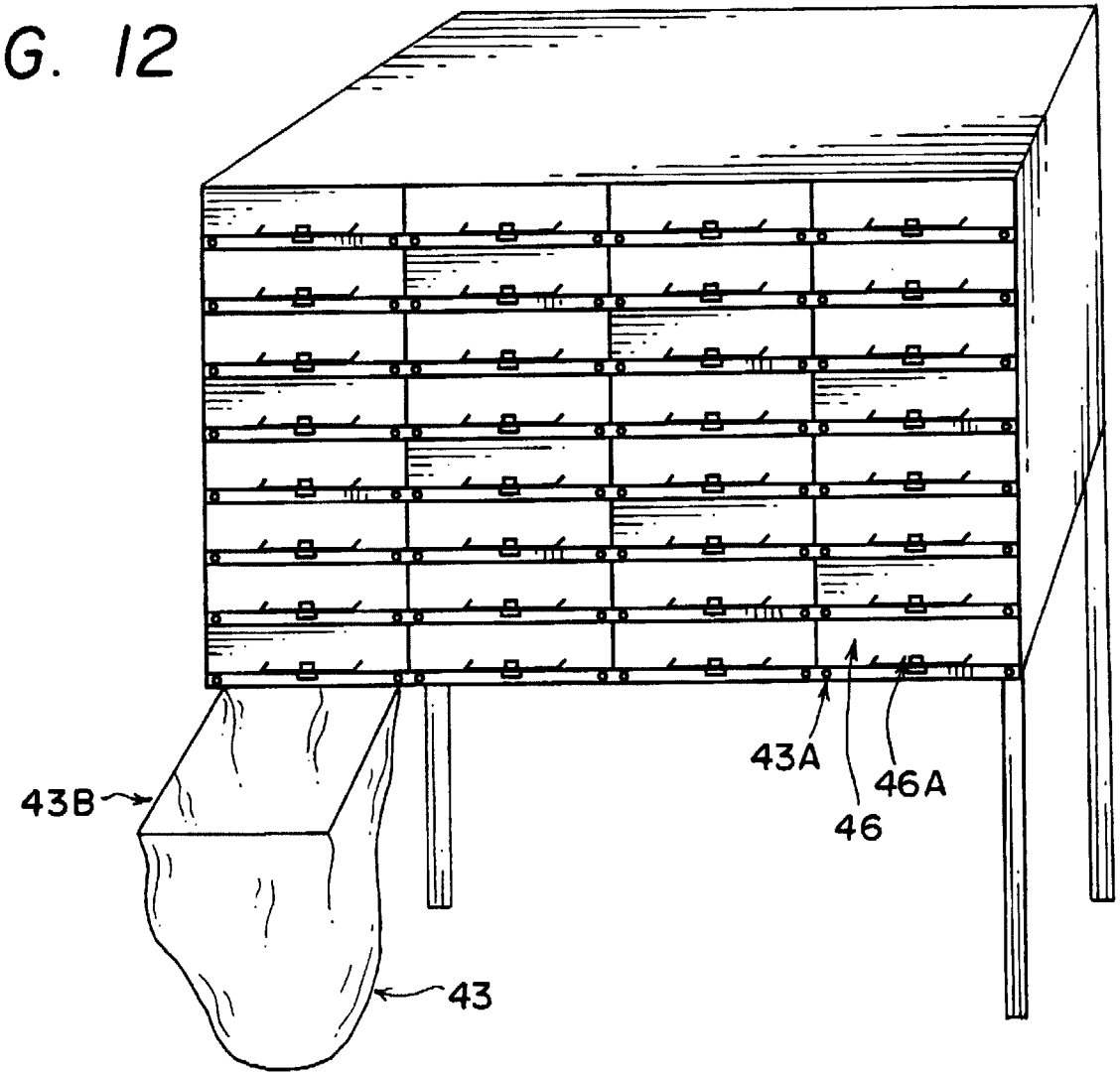
FIG. 12 shows an alternate approach to materials handling where the chute blocker is deployed during sortation and is opened when the chute is filled or sortation is complete to fill sacks or containers that are attached to the chute prior to opening the chute blocker.

FIG. 12 shows an alternate approach to materials handling for the semi-automated integrated sort system. The material handling system is composed of multiple chutes 41. In the example shown there are 32 chutes in a grid that is 4 chutes wide by 8 chutes high. The grid shown is designed for small package sortation and each chute is roughly 6 inches high by 12 inches wide. The end of each chute is normally blocked by a chute blocker 46, secured by a latch 46A. When the chute is full of packages or all of the packages are sorted, the operator attaches a container or sack 43 (held by a metal frame 43B in this case) to the container attachment points 43A, unfastens the latch 46A, and opens the chute blocker 46.

This allows the shipments in the chute to gravity-flow into the container or sack 43. Once a given chute has been emptied of packages, the process is repeated chute by chute until all of the chutes that need to be emptied have been emptied.

Figure 13:
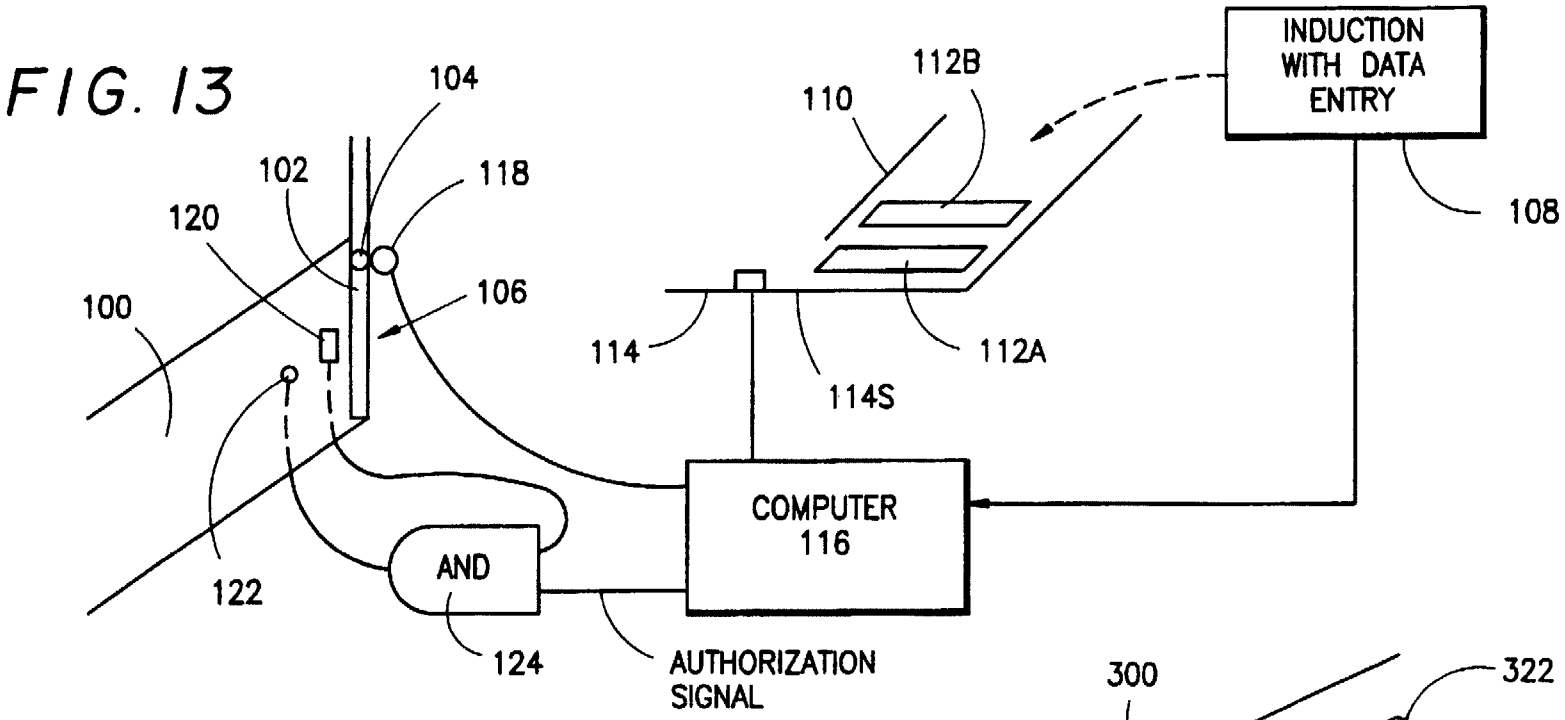
FIG. 13 is a simplified side view (with one side wall removed) of a sorting chute according to the present invention combined with a simplified block diagram.

FIG. 13 is a simplified side view (with one side wall removed) of a sorting chute 100 according to the present invention combined with a simplified block diagram. Only one chute 100 is shown for this and the following other figures, but it will be readily appreciated that the chute would be one of an array of chutes as shown for the previous designs. The chutes are arranged for one or more persons to place packages therein. A gate 102 is hinged at hinges 104 such that the gate is disposed by gravity in a vertical position blocking the port 106 at the entrance to chute 100. Packages have their data entered through the various discussed methods at an induction station 108. The induction station has a chute 110 where packages such as 112A and 112B proceed in order. When the packages arrive at the output 114 of chute 110, which is at the sorter input work station, a person (not shown) slides package 112A across surface 114S. The package 112A is slid across and triggers microswitch 114 which signals computer 116 that a package has been removed. Since the computer has stored the destination information for package 112A at induction station 108 and the computer keeps track of the order of the packages in induction chute 110 (this could alternately be a passageway with a conveyor), the computer immediately lights LED 118 to signal the human sorter that the associated chute 100 is the proper one to insert package 112A. The sorter person simply pushes gate 102 back and inserts the package. Although not shown, there would preferably be an LED associated with each of numerous sort chutes.

In addition to signaling the person as to which chute is correct, the arrangement of FIG. 13 blocks the misplacement of packages. Specifically, a microswitch 120 and solenoid gate lock 122 are on a side wall of each chute such as chute 100. When the microswitch 120 signals that the gate 102 is being opened, solenoid lock 122 will extend blocking complete opening of the gate unless the computer 116 has sent an authorization signal to AND gate 124 which blocks the extension of solenoid 122. It will be readily appreciated that the function of AND gate 124 could be performed by software within the computer 116. By only locking gates when a human sorter error has occurred (as detected by microswitch 120), the mechanical parts of the system such as the lock will last longer.

Figure 14:
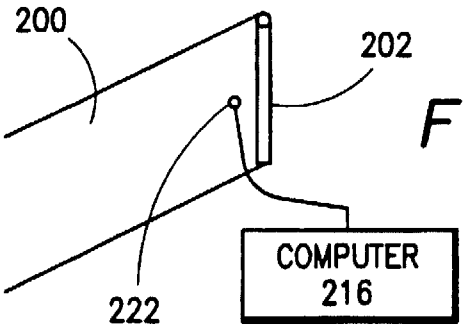
FIG. 14 is a simplified side view of a modified sorting chute.

FIG. 14 shows a modification from FIG. 13 wherein a chute 200 works in the same way as FIG. 13 except that a solenoid is retracted by control of computer 216 only when a particular gate 202 is the proper one to be opened. Normally all the gates would be locked in this arrangement except when a package is to be inserted in a particular chute whose gate is then unlocked.

Figure 15:
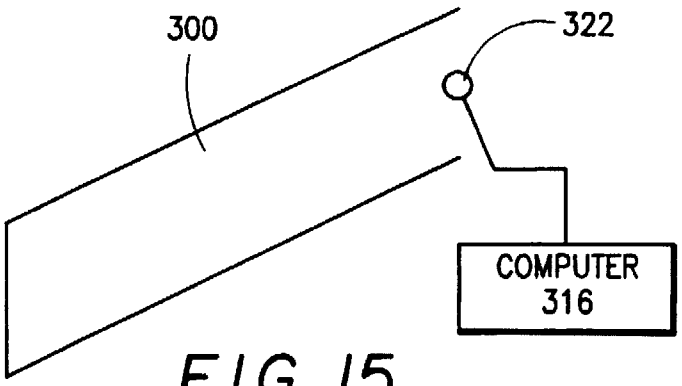
FIG. 15 is a simplified side view of yet another modified sorting chute.

FIG. 15 operates as with FIG. 14 except that a solenoid 322 is controlled by computer 316 so as to serve as the gate for chute 300. The solenoid/gate 322 is automatically opened by computer 316 when the associated chute is to have a package inserted therein based on destination information entered at an upstream induction station (such as 108 of FIG. 13).

Although not shown, the arrangements of FIGS. 14 and 15 may have LEDs or other lights or visual indicators such as 118 of FIG. 13.

Figure 16:
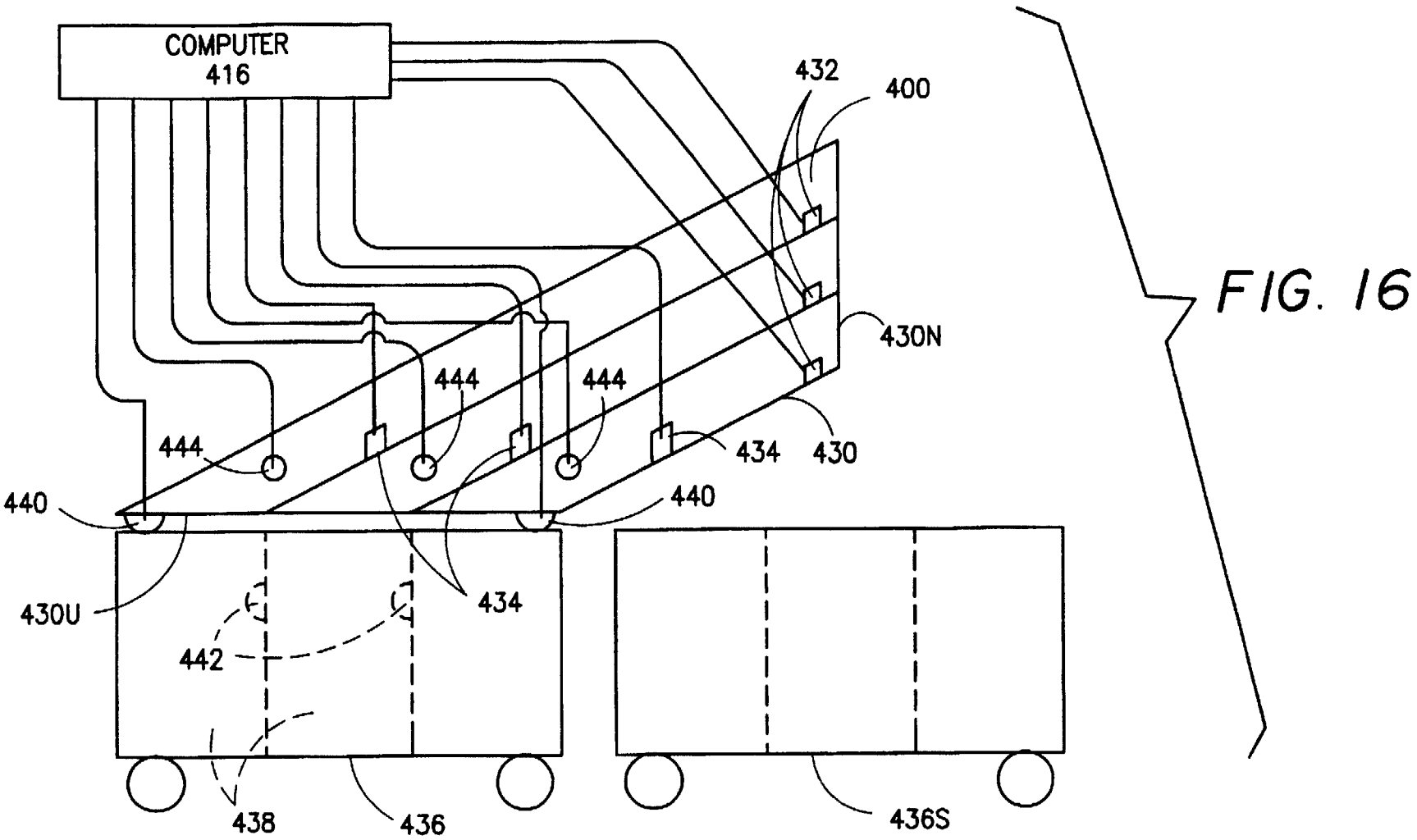
FIG. 16 is a simplified side view of chutes of a chute array.

FIG. 16 shows a side view of chutes 400 of chute array 430, which is similar to 41 of FIG. 8 in that it has vertical or substantially vertical (i.e., within 10 degrees of vertical) input side 430N and a horizontal output side (i.e., bottom) 430U. Only one column of chutes are shown, but it will be appreciated that the chutes would be arranged in columns and rows as shown for the chutes of FIG. 8. Microswitches 432 are disposed near the top of each chute and signal computer 416 when a package is inserted therein. Microswitches 434 signal the computer when a package leaves the corresponding chute 400.

At the output side or bottom 430U of chute array structure 430 is a first cart 436 having bins 438 corresponding on a one-to-one basis with the chutes. Microswitches 440 (connection wires not shown for ease of illustration) signal computer 416 when the cart 436 is in place below 430U. Each bin 438 has a corresponding microswitch 442 which signals the computer when a package is received in that bin. Additionally, when microswitch 442 is constantly closed when that bin is full such that computer 416 is notified that the cart 436 must be replaced. A person may push the first cart 436 out from under 430U and insert an identical second cart 436S. When one or more of the microswitches 440 indicate that no cart is properly placed below 430U, computer 416 extends solenoid exit gates 444 to block packages from exiting the chutes 400 until a replacement cart is properly position as determined by microswitches 440. When the replacement or second cart is in place, the solenoid gates 444 are retracted and packages again exit from the chutes 400.

If the arrangement of FIG. 16 uses only indicators (not shown) for indicating which chute a package should go in (instead of using the locks or gates), a sorter person may occasionally place a package in the wrong chute 400 such that it ends up in the wrong bin 438. However, the computer 416 is signaled when this happens by microswitches 432. Computer 416 then keeps track of which bin 438 of a particular cart has a misplaced package. The computer may then notify a person at downstream location that for example, bin D-7 of cart 25 has a misplaced package third from the top of that bin. The person may then easily remove the misplaced package and place it in the proper bin.

Although various sensors have been described as microswitches, other types of sensors could be used for the various functions described. In similar fashion, reference has been made to solenoids, but other electrically operated mechanical components could be used in place thereof.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A package sort system comprising:

a sorter input work station from which packages in a package stream are supplied to a sorter person;

a plurality of manual ports adjacent the sorter input work station for the sorter person to manually insert packages from the sorter input work station for further processing;

a plurality of gates, each associated with at least a corresponding one or more of the manual ports, the gates individually movable between a closed position blocking access to corresponding manual ports and an open position allowing access to corresponding manual ports; and a computer holding destination information relative to intended destinations of packages in the package stream at the sorter input work station, the computer operably connected to the plurality of gates for allowing access to a particular manual port based on the destination information for a particular package being manually sorted by the sorter person at a given time such that the sorter person may manually insert that package in particular manual port.

2. The package sort system of claim 1 further comprising a plurality of gate openers, each operably connected to a corresponding one of the plurality of gates for opening that gate and operably connected to the computer, wherein the computer is operable to send opening signals to the plurality of gate openers such that the gates are opened dependent on the destination information for a particular package being manually sorted by the sorter person at a given time.

3. The package sort system of claim 1 further comprising a plurality of gate locks, each operably connected to a corresponding one of the plurality of gates for locking that gate and operably connected to the computer, wherein the computer is operable to send unlocking signals to the plurality of gate locks such that the gates are unlocked dependent on the destination information for a particular package being manually sorted by the sorter person at a given time such that the sorter person can manually open a correct one of the gates for the particular package.

4. The package sort system of claim 1 further comprising a plurality of gate locks, each operably connected to a corresponding one of the plurality of gates for locking that gate and operably connected to the computer, and a plurality of gate sensors, each corresponding to one of the plurality of gates and sensing when that gate is moved, and wherein the computer is operable to control the plurality of gate locks such that each gate is locked responsive to movement sensed by its gate sensor and dependent on the destination information for a particular package being manually sorted by the sorter person at a given time such that the sorter person can manually open a correct one of the plurality of gates for the particular package.

5. The package sort system of claim 1 further comprising:

a plurality of passageways, each having a corresponding outlet and each passageway corresponding to a corresponding one of the plurality of manual ports and communicating therewith such that a package inserted into a manual port proceeds in the corresponding passageway to the corresponding outlet;

a first cart at the outlets of the passageways, the first cart having bins, each bin receiving packages from a corresponding outlet and corresponding to a corresponding one of the manual ports such that packages inserted into a manual port proceed into the corresponding bin; and a second cart having bins and constructed as recited for the first cart; and wherein the first cart is movable from the outlets of the passageways and the second cart is movable into a location previously occupied by the first cart such that it may assume the receiving of packages from the outlets as previously performed by the first cart.

6. The package sort system of claim 1 further comprising:

an induction work station into which packages of the package stream go in an order, the computer storing information indicating the order of the packages going into the induction work station; and a sort sensor at the sorter input work station and operably connected to provide a signal to the computer when a particular package is ready to be sorted; and wherein the sorter input work station is operably connected to the induction work station such that packages from the induction work station proceed in order to the sorter input work station and from which packages in the package stream are supplied to a sorter for sorting, and wherein the computer controls the gates to direct sorting of a particular package responsive to the destination location of the package as determined from the order of packages stored by the computer.

7. The package sort system of claim 6 further comprising a bar code reader adjacent the induction work station and operable to input destination information to the computer based on the reading of bar code on packages.

8. The package sort system of claim 6 further comprising an information input interface operably connected to the computer for entering destination information to the computer, and wherein the input interface is selected from the group consisting of:

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer.

9. The sort system of claim 1 wherein each manual port is an entry point for a corresponding passageway, which passageway is selected from the group consisting of: a chute and a conveyer, wherein individual passageways are normally blocked by exit gates, which can be opened by a human operator to empty the contents of the passageways into containers.

10. The sort system of claim 1, where in the gates are normally closed, and are physically opened by the system to provide access to the ports.

11. The sort system of claim 1, wherein the gates are normally locked during operation, and are physically unlocked by the system to provide access to the ports.

12. The sort system of claim 1 further comprising port sensors, and wherein the operation of the gate is determined by a combination of data from the port sensors, and the item information.

13. The sort system of claim 12, wherein the gates are normally unlocked, and wherein, if the system detects that an item being inserted into a port, and if the item in question is not supposed to be inserted into that port, the system will lock the gate on that port to prevent the item from entering the port.

14. The sort system in claim 1 further comprising a computer system, such as a computer network, receiving information from multiple computers at geographical separated locations where sorting is being performed.

15. The sort system in claim 14 wherein the computer system forwards information to the geographical separated locations to alter or adjust system operation at the locations.

16. The sort system in claim 15, wherein the computer system is used to change the assignment of specific item destinations to specific ports, or to provide instructions on how a specific package should be processed.

17. The sort system in claim 1 further comprising data entry means connected to the computer for entering destination information and including any one or more of the following: bar-code reader, optical character reader, remote data encoding, voice recognition system, manual keyboard entry, or computer-assisted keyboard entry.

18. The sort system in claim 14 wherein the data entry means include electronic data transfer from another device, wherein the inbound item is processed in such a fashion that destination data entered on, produced by, or forwarded to another device, and then transfered from that device to the sorting system, can be associated with a specific item.

19. A package sort system comprising:

a sorter input work station from which packages in a package stream are supplied to a sorter person;

a plurality of manual ports adjacent the sorter input work station for the sorter person to manually insert packages from the sorter input work station for further processing;

a plurality of visual indicators, each associated with at least a corresponding one of the manual ports, the visual indicators indicating to the sorter person which of plurality of manual ports a package should be inserted in;

a plurality of port sensors operable to sense which of the plurality of manual ports a package is inserted into; and a computer holding destination information relative to intended destinations of packages in the package stream at the sorter input work station, the computer operably connected to the plurality of port sensors such that the computer receives a signal when a package is misplaced into an incorrect port; and a downstream location downstream from the plurality of ports such that packages inserted into the plurality of ports proceed to the downstream location; and wherein the computer is operable to track the misplaced package until it reaches the downstream location such that the misplacement of the misplaced package can be corrected at the downstream location.

20. The package sort system of claim 19 wherein the computer is operable to record a performance rate for a given sorter person, the performance rate dependent on the accuracy of the sorter person in inserting the packages into proper manual ports.

21. The package sort system of claim 19 further comprising:

an induction work station into which packages of the package stream go in an order, the computer storing information indicating the order of the packages going into the induction work station; and a sort sensor at the sorter input work station and operably connected to provide a signal to the computer when a particular package is ready to be sorted; and wherein the sorter input work station is operably connected to the induction work station such that packages from the induction work station proceed in order to the sorter input work station and from which packages in the package stream are supplied to a sorter for sorting, and wherein the computer directs sorting of a particular package responsive to the destination location of the package as determined from the order of packages stored by the computer.

22. The package sort system of claim 21 further comprising an information input interface operably connected to the computer for entering destination information to the computer, and wherein the input interface is selected from the group consisting of:

a bar code reader adjacent the induction work station and operable to input destination information to the computer based on the reading of bar code on packages;

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer.

23. The package sort system of claim 22 wherein the input interface includes at least two members of the recited group.

24. A package sort system comprising:

a sorter input work station from which packages in a package stream are supplied to a sorter person;

a plurality of manual ports adjacent the sorter input work station for the sorter to manually insert packages from the sorter input work station for further processing;

a plurality of indicators, each associated with at least a corresponding one or more of the manual ports, the indicators indicating to the sorter person which of the manual ports packages should be inserted into;

a computer holding destination information relative to intended destinations of packages in the package stream at the sorter input work station, the computer operably connected to the plurality of indicators for controlling them based on the destination information for a particular package being manually sorted by the sorter person at a given time such that the sorter person manually inserts that package in a particular manual port;

a plurality of passageways, each having a corresponding outlet and each passageway corresponding to a corresponding one of the plurality of manual ports and communicating therewith such that a package inserted into a manual port proceeds in the corresponding passageway to the corresponding outlet;

a plurality of at least partially confined holding zones at the outlets of the passageways, there being a distinct holding zone at each outlet; and wherein the holding zones are movable relative to the outlets such that an empty holding zone can be replaced for a full holding zone without moving the corresponding outlet and the corresponding passageway.

25. The package sort system of claim 24 further comprising first and second carts, and wherein each of the holding zones is one of a plurality of bins on the first and second carts, each bin receiving packages from a corresponding outlet and corresponding to a corresponding one of the manual ports such that packages inserted into a manual port proceed into the corresponding bin; and wherein the first cart is movable from the outlets of the passageways and the second cart is movable into a location previously occupied by the first cart such that it may assume the receiving of packages from the outlets as previously performed by the first cart.

26. The package sort system of claim 25 further comprising:

a plurality of transfer sensors operably connected to the computer and sensing when a package is transferred from one of the outlets to the corresponding bin; and an induction work station into which packages of the package stream go in an order, the computer storing information indicating the order of the packages going into the induction work station, the induction work station is operably connected to the sorter input work station such that packages from the induction work station proceed in order to the sorter input work station; and a sort sensor at the sorter input work station and operably connected to provide a signal to the computer when a particular package is ready to be sorted; and wherein the computer stores information corresponding to an indication of the transfer of each package and wherein the computer directs sorting of a particular package responsive to the destination location of the package as determined from the order of packages stored by the computer by controlling the indicators.

27. The package sort system of claim 26 further comprising an information input interface operably connected to the computer for entering destination information to the computer, and wherein the input interface is selected from the group consisting of:

a bar code reader adjacent the induction work station and operable to input destination information to the computer based on the reading of bar code on packages;

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer.

28. The package sort system of claim 25 wherein the indicators are visual indicators and further comprising:

a plurality of port sensors operable to sense which of the plurality of manual ports a package is inserted into; and wherein the computer is operably connected to the plurality of port sensors such that the computer receives a signal when a package is misplaced into an incorrect port; and wherein the computer is operable to record a performance rate for a given sorter person, the performance rate dependent on the accuracy of the sorter person in inserting the packages into proper manual ports.

29. The package sort system of claim 28 further comprising:

a downstream location downstream from the plurality of ports such that packages inserted into the plurality of ports proceed to the downstream location; and wherein the computer is operable to track the misplaced package until it reaches the downstream location such that the misplacement of the misplaced package can be corrected at the downstream location.

30. The package sort system of claim 24 further comprising a plurality of gates, each associated with at least a corresponding one or more of the manual ports, the gates individually movable between a closed position blocking access to corresponding manual ports and an open position allowing access to corresponding manual ports, and wherein the indicators indicate which manual port a particular package should be inserted into by affecting the gates; and wherein the indicators are selected from the group consisting of:

gate openers which open the gates as appropriate for insertion of the packages, the opening of a gate thus indicating which manual port should be used; and gate locks which lock and unlock the gates as appropriate for insertion of the packages, an unlocked condition of a gate thus indicating which manual port should be used and a locked condition of a gate thus indicating that the corresponding manual port should not be used.

31. The sort system in claim 24, further comprising one or more sensor or input devices located in or near the holding zones and operable to determine when the holding zones are full.

32. The sort system in claim 31, wherein the sensors are used with specially designed containers, such that an external signal emitter attached to the sort system can transmit a signal through the container, or through an opening in the container, to an external signal detector.

33. The sort system in claim 31 further comprising indicators that identify holding zones that need to be replaced.

34. The sort system in claim 31 wherein a sensor or input device is used to detect when an individual holding zone is replaced.

35. The sort system in claim 24, wherein a blocking device is disposed near the outlet of each passageway and assumes a blocking mode if the holding zone has been removed or is currently being replaced, the blocking device will prevent packages from exiting the outlet until the holding zone is replaced.

36. The sort system in claim 35 where the system is capable of associating destination data with specific items that are awaiting sorting, even if other items destination data is entered between the time the specific item(s) awaiting sorting destination data is input, and the time the specific item(s) awaiting sorting are actually sorted, and wherein this is achieved by using a bin that maintains the items in a known order, which has sensors located at the entrance and exit of the bin able to detect the insertion or removal of an item.

37. A package sort system comprising:

a computer holding destination information relative to intended destinations of packages in the package stream which are to be sorted;

an induction work station into which packages of the package stream go in an order, the computer storing information indicating the order of the packages going into the induction work station;

a sorter input work station operably connected to the induction work station such that packages from the induction work station proceed in order to the sorter input work station and from which packages in the package stream are supplied to a sorter person for sorting;

a plurality of manual ports adjacent the sorter input work station for the sorter person to insert packages from the sorter input work station for further processing; and a sort sensor at the sorter input work station and operably connected to provide a signal to the computer when a particular package is ready to be sorted; and wherein the computer is operable to direct sorting of the particular package responsive to the destination location of the package as determined from the order of packages stored by the computer.

38. The package sort system of claim 37 further comprising:

a plurality of indicators, each associated with at least a corresponding one or more of the ports, the indicators indicating to the sorter person which of the ports packages should be inserted into;

wherein the computer is operably connected to the indicators such that it directs sorting of the packages by controlling the indicators responsive to the destination location of the package as determined from the order of packages as stored by the computer.

39. The sort system in claim 38, wherein the indicators means include two or more differentiable means of directing the sort, so that the system can direct multiple human sorters at the same time using a common set of manual ports by directing each of the manual operators using a unique directing method.

40. The sort system in claim 39, wherein the indicators comprise lights of at least two different colors, one color for each sorter person.

41. The sort system in claim 38, wherein the indicators are audible.

42. The package sort system of claim 37 further comprising a plurality of gates, each associated with at least a corresponding one or more of the manual ports, the gates individually movable between a closed position blocking access to corresponding manual ports and an open position allowing access to corresponding manual ports, and wherein the indicators indicate which manual port a particular package should be inserted into by affecting the gates; and wherein the indicators are selected from the group consisting of:

gate openers which open the gates as appropriate for insertion of the packages, the opening of a gate thus indicating which manual port should be used; and gate locks which lock and unlock the gates as appropriate for insertion of the packages, an unlocked condition of a gate thus indicating which manual port should be used and a locked condition of a gate thus indicating that the corresponding manual port should not be used.

43. The package sort system of claim 37 wherein the indicators are lights which are located immediately adjacent to the manual ports and which light up to indicate which port a particular package should be inserted into.

44. The package sort system of claim 37 further comprising an information input interface at the induction work station and operably connected to the computer for entering destination information to the computer, and wherein the input interface is selected from the group consisting of:

a bar code reader adjacent the induction work station and operable to input destination information to the computer based on the reading of bar code on packages;

an optical reader operably connected to the computer such that the computer performs optical character recognition of alphanumeric characters on packages;

a microphone operably connected to the computer such that a person observing packages announces destination information, which is stored in the computer after voice recognition of the announced destination information; and a manual input device such that a person observing packages manually inputs destination information for storage in the computer.

45. The package sort system of claim 44 wherein the input interface includes at least two members of the recited group.

46. The package sort system of claim 44 further comprising:

a plurality of passageways, each having a corresponding outlet and each passageway corresponding to a corresponding one of the plurality of manual ports and communicating therewith such that a package inserted into a manual port proceeds in the corresponding passageway to the corresponding outlet;

a first cart at the outlets of the passageways, the first cart having bins, each bin receiving packages from a corresponding outlet and corresponding to a corresponding one of the manual ports such that packages inserted into a manual port proceed into the corresponding bin; and a second cart having bins and constructed as recited for the first cart; and wherein the first cart is movable from the outlets of the passageways and the second cart is movable into a location previously occupied by the first cart such that it may assume the receiving of packages from the outlets as previously performed by the first cart.

47. The package sort system of claim 46 further comprising:

a plurality of transfer sensors operably connected to the computer and sensing when a package is transferred from one of the outlets to the corresponding bin; and wherein the computer stores information corresponding to an indication of the transfer of each package.

48. A shipment data entry station comprising:

input means for entering information relative to an item;

a printer capable of printing machine-readable data;

either a sort system similar to that outlined in claim 1, or a means to associate the entered item data with the item at a subsequent process, even if other item's data is entered between the time the specific item(s) awaiting processing's data is input, and the time the specific item(s) awaiting processing are actually sorted; and wherein the data is associated with a specific item by using a bin that maintains the items in a known order, which has sensors located at the entrance and exit of the bin able to detect the insertion or removal of an item; and wherein the data entry means include any of the following: a bar-code reader, optical character recognition, an electronic scale, voice recognition, remote data encoding, or a keyboard; and wherein the data entry means include computer-assisted manual entry, wherein the computer will look-up the item destination by comparing a limited number of operator input keystrokes to a database, and selecting the possible item destination(s) that contain those keystrokes, and wherein, in the event that multiple item destinations are possible based on the data entered, the system will supply the human-operator with a brief list of possible destinations and ask the human-operator to select the appropriate destination;

and further comprising one or more holding bins, each capable of holding one or more items, wherein a directing means can direct a human operator to insert or withdraw an item from a given holding bin; and wherein the directing means includes lights of two or more colors located at or near the entrance to the holding bin, with one color of light corresponding to an insert item request, and another color of light corresponding to a withdraw item request, and wherein the entrance to the holding bin is equipped with sensors to measure when an item is inserted or withdrawn from the bin.

49. A method of sorting, with the aid of a sort assisting system, said sort assisting system having:

a plurality of manual ports;

a plurality of chutes, conveyers, or other material handling devices;

input means for receiving information relative to the intended destination of an item;

directing means to alert the sort person of the appropriate manual port; and a data storage system to monitor and record system operating data;

said method comprising:

a. causing the item data to be input or associated with the item;

b. placing said particular item in one of said manual ports as directed by the system based on the item data; and wherein the sort assisting system also comprises a plurality of sensors able to detect when an item is placed in the correct (or incorrect) manual port, and wherein this data is used to record the human sort operators' overall productivity and accuracy; and wherein the sort assisting system also comprises an interface with a separate computer system, and wherein, in the event of a mis-sort, the sort assisting system will alert the separate computer system, such that the separate computer system can direct someone to correct the mis-sort at a downstream location; and wherein the sort assisting system also comprises an interface with a separate computer system, and wherein, the sort assisting system forwards the item information to the separate computer system, such that the data may be used for other purposes not related to sorting the package, such as billing; and wherein the sort assisting system also receives information from the central computer system, such that the central computer system can instruct the sort operator to provide an individual item with special processing, such as in-transit forwarding, that could not be inferred from the item's own data alone; and wherein the sort assisting system also comprises one or more holding bins equipped with directing lights and sensors, and wherein, if the item cannot be efficiently processed at that time (such as if the destination container is currently full or being replaced or if the system requires more time to determine the appropriate destination), the system will direct the operate to insert the item into the holding bin, and will stop directing the operator to do so when the system detects that the operator has inserted a package, at a later time, when the system is able to efficiently process the item in the holding bin, the system will then direct the operator to withdraw the item from the holding bin, and will then use the information associated with that item-even if data for other items has been entered in the intervening time-to direct the processing of that item; wherein the sort assisting system also functions as an item induction station, and also comprises a computer printer and one or more data input means include both automated and non-automated/semi-automated data entry; and the method comprising:

(a) entering item data using automated data entry (b) reentering or using a back-up data entry method if the automated data entry is unsuccessful (c) applying machine readable item data to the item if the item lacks such data (d) sorting the item as described above in the first-mentioned a and b.

* * * * *

UNITED STATES PATENT AND TRADEMARK OFFICE

CERTIFICATE OF CORRECTION

PATENT NO. : 5,794,789

DATED : August 18, 1998

INVENTOR(S) : PAYSON et al

It is certified that error appears in the above-indentified patent and that said Letters Patent is hereby corrected as shown below:

Claim 10, line 1, (column 25, line 37), change "where in" to -- wherein --;

Claim 18, line 1 (column 26, line 3), change "14" to -- 17 --;

Claim 49, line 49 (column 32, line 46), change "package, at" to -- package. At --.

Signed and Sealed this

Thirty-first Day of August, 1999

*Attest:*

Q. TODD DICKINSON

*Attesting Officer*

*Acting Commissioner of Patents and Trademarks*